US012179971B2

(12) United States Patent
Trasacco et al.

(10) Patent No.: US 12,179,971 B2
(45) Date of Patent: Dec. 31, 2024

(54) PLATE POCKET FOR PIZZA BOX

(71) Applicants: Barry Trasacco, West Haven, CT (US); Tony Rizzaro, South Salem, NY (US)

(72) Inventors: Barry Trasacco, West Haven, CT (US); Tony Rizzaro, South Salem, NY (US)

( * ) Notice: Subject to any disclaimer, the term of this patent is extended or adjusted under 35 U.S.C. 154(b) by 170 days.

(21) Appl. No.: 17/991,433

(22) Filed: Nov. 21, 2022

(65) Prior Publication Data

US 2023/0192353 A1 Jun. 22, 2023

Related U.S. Application Data

(63) Continuation-in-part of application No. 17/000,803, filed on Aug. 24, 2020, now Pat. No. 11,505,361, (Continued)

(51) Int. Cl.
*B65D 5/48* (2006.01)
*B65B 5/02* (2006.01)
(Continued)

(52) U.S. Cl.
CPC ..... *B65D 5/48002* (2013.01); *B65B 5/024* (2013.01); *B65B 5/06* (2013.01); *B65D 5/18* (2013.01); *B65D 5/5028* (2013.01); *B65D 5/6685* (2013.01); *B65D 85/36* (2013.01); *B65D 2585/366* (2013.01)

(58) Field of Classification Search
CPC ..... B65D 2585/366; B65D 85/36; B65D 5/5028; B65D 5/18; B65D 5/48002; B65D 5/48024; B65D 5/4233; B65D 81/3853; A47G 23/0608; A47G 21/001; A47G 47/14; B65B 5/024; B65B 5/08; B65B 25/16
USPC ..... 229/906, 103, 120.32, 904, 902; 206/223, 549, 551, 562, 749; 426/115, 426/128
See application file for complete search history.

(56) References Cited

U.S. PATENT DOCUMENTS 4,572,423 A 2/1986 Spencer
4,819,862 A 4/1989 Maroszek
(Continued)

FOREIGN PATENT DOCUMENTS

CN 107835772 A * 3/2018 ..... A41D 13/04
FR 2726812 A1 * 5/1996 ..... B65D 25/205
(Continued)

*Primary Examiner* — Christopher R Demeree
(74) *Attorney, Agent, or Firm* — Eric L. Lane; Green Patent & IP Law

(57) ABSTRACT

A box useful for pizza, a method of assembling the box, and method of using the box are described herein. The box comprises a base having sidewalls extending therefrom, a box lid having a top surface and a bottom surface, the box lid hingedly connected to one of the base sidewalls, the box lid further having foldable flaps extending therefrom. A plate pocket extends from and is connected to secured to an edge of the box lid, and plate pocket comprises a base with sidewalls extending therefrom, the plate pocket sidewalls extending towards the box lid bottom surface when the box is in an assembled position, and may contain plate pocket accessories within a plate pocket cavity.

14 Claims, 27 Drawing Sheets

Related U.S. Application Data which is a continuation-in-part of application No. 16/930,806, filed on Jul. 16, 2020, now Pat. No. 11,731,802.

(60) Provisional application No. 62/875,637, filed on Jul. 18, 2019.

(51) Int. Cl.

| | |
|---|---|
| ***B65B 5/06*** | (2006.01) |
| ***B65D 5/18*** | (2006.01) |
| ***B65D 5/50*** | (2006.01) |
| ***B65D 5/66*** | (2006.01) |
| ***B65D 85/36*** | (2006.01) |

(56) References Cited

U.S. PATENT DOCUMENTS

| | | | |
|---|---|---|---|
| 4,836,383 | A | 6/1989 | Gordon et al. |
| 5,110,038 | A | 5/1992 | Pantisano et al. |
| 5,509,601 | A | 4/1996 | Drabick |
| 5,542,540 | A | 8/1996 | Knapp et al. |
| 6,386,440 | B1 | 5/2002 | Tulkoff |
| 6,755,711 | B2 | 6/2004 | McClung et al. |
| 6,899,587 | B2 | 5/2005 | McClung et al. |
| 6,905,065 | B2 | 6/2005 | Holden |
| 7,222,778 | B2 | 5/2007 | Smith et al. |
| 8,770,466 | B1 | 7/2014 | Terlesky et al. |
| 10,166,451 | B1 | 1/2019 | Laskowitz |
| 11,066,207 | B2 | 7/2021 | Cavaceppi |
| 2003/0029769 | A1 | 2/2003 | Ausif |
| 2006/0226206 | A1 | 10/2006 | Reap |
| 2011/0186621 | A1 | 8/2011 | Parker |

FOREIGN PATENT DOCUMENTS

| | | | | |
|---|---|---|---|---|
| WO | WO-2011070563 A1 * | 6/2011 | ..... | B65D 85/36 |
| WO | 2015123709 | 8/2015 | | |
| WO | WO-2019030663 A1 * | 2/2019 | ..... | B65D 5/4237 |

* cited by examiner

PLATE POCKET FOR PIZZA BOX

BACKGROUND OF THE INVENTION

1. Field of the Invention

The present invention relates to a system, apparatus and method for packaging and delivering serving plates along with a pizza in the same size as an otherwise standard pizza box.

2. Description of Related Art

Customers who order take-out pizza or pizza for delivery eventually need to have serving plates on which to serve the pizza slices. Currently such serving plates are either not supplied with the take-out or delivered pizza at all, or are packaged separately, in a manner which is often awkward and difficult to handle with the pizza box.

U.S. patent application Ser. No. 2011/0186621 published to Parker and titled "PIZZA BOX WITH STORAGE COMPARTMENTS" discloses a pizza box with full width storage compartments located on the top and bottom lids of the box for holding paper plates/collapsible cups. These compartments are accessible by removing separate cardboard inserts that are sealed by a peel-off adhesive ring disposed on the top and bottom lids. This requires adhesively binding the inserts to the lids and providing completely separate compartments within the pizza box itself.

It would be advantageous to provide an improved packaging procedure to make the process of accessing the plates easier for end users (e.g., people receiving the delivery/takeout order) and provide a more environmentally friendly solution that does not waste excess cardboard in forming the pizza box.

SUMMARY OF THE INVENTION

Bearing in mind the problems and deficiencies of the prior art, it is therefore an object of the present invention to provide an improved system, apparatus and method for packaging and delivering serving plates, napkins, utensils, and the like along with a pizza, calzone, or other food-based product in similar size to an otherwise standard pizza box.

It is another object of the present invention to provide a pizza box with a plate pocket formed within the box and having a pocket lid that is formed without necessitating excess cardboard.

Yet another object of the present invention is to provide an improved method for using a box to store plates, napkins, utensils, and the like along with a pizza, calzone, or other food-based product therein.

Still another object of the present invention is to provide an improved method for making a box for storing plates, napkins, utensils, and the like along with a pizza, calzone, or other food-based product therein.

The above and other objects, which will be apparent to those skilled in the art, are achieved in the present invention which is directed to a pizza box, comprising a base having sidewalls extending perpendicular from its edges, and a lid having a top surface and a bottom surface connected to one of said sidewalls, such that the lid may swing from an open position exposing the inside of the box to a closed position resting adjacent to the sidewalls. A plate pocket extends downwards from the bottom surface of the box lid a distance that is less than the total depth of the box. This plate pocket is sized to receive at least one plate therein. A plate pocket lid is formed from the box lid top surface via a cut or perforations cut into the box lid. A portion of the plate pocket lid is not cut or perforated to act as a living hinge that allows for the plate pocket lid to swing between an open position exposing the inside of the plate pocket to a closed position resting flush with the box lid top surface.

In an embodiment, the pizza box includes a separator disposed within the pizza box to support the pocket when the lid is in the closed position. The plate pocket lid may have dimensions comparable to the plate pocket. A lid tab may be disposed on an end of the plate pocket lid opposite of the living hinge to allow for an easier grip and control of the plate pocket lid when swinging the plate pocket lid about its living hinge. The plate pocket may be formed in a substantially ellipse shape. The plate pocket lid may also be formed in a substantially ellipse shape. Alternatively, the plate pocket may be formed to substantially cover an inside surface of the box lid, such that connecting flaps of the plate pocket adhere to the bottom surface of the box lid, or to foldable flaps or flanges that extend downwardly from a perimeter of the box lid. The plate pocket lid may be formed into a parallelogram shape.

The present invention is further directed to a method of assembling a box useful for takeout food, comprising providing a box blank having a first portion comprising a base portion and sidewall portions hingedly coupled to the base portion by a plurality of first portion folding lines, a second portion hingedly coupled to one of the first portion sidewall portions. The second portion comprises a lid base portion and lid sidewall portions hingedly coupled to the lid base portion by a plurality of second portion folding lines. The second portion further comprises a plate pocket hingedly coupled to an edge of the lid base portions, the plate pocket comprising base portion and plate pocket sidewall portions hingedly coupled to the plate pocket base portion by a plurality of plate pocket folding lines. The method includes folding the first portion sidewall portions towards the first portion base portion along at least one of the plurality of first portion folding lines such that the first portion sidewall portions are approximately perpendicular to the first portion base portion. The method further comprises folding the second portion lid sidewall portions towards the lid base portion along at least one of plurality of second portion folding lines such that the lid sidewall portions are approximately perpendicular to the lid base portion. The method may comprise folding the plate pocket sidewall portions towards the plate pocket base portion along at least one of the plurality of plate pocket folding lines such that the plate pocket sidewall portions are approximately perpendicular to the plate pocket base portion. The method may then include moving the plate pocket into a position approximately parallel to the lid base portion, and moving the second portion into a position such that the lid sidewall portions are nested into and between the first portion sidewalls. After assembly, the plate pocket may be movable between a closed position wherein an interior portion of the plate pocket is inaccessible, to an open position wherein the interior of the plate pocket is accessible. The method may further comprise placing plate pocket accessories into an interior portion of the plate pocket for access thereto when the plate pocket is in the open position. The plate pocket may comprise at least one ab member and wherein the first portion base portion further comprises an opening, such that the method may further comprise securing the at least one tab member within the first portion base portion opening.

Further aspects of the present invention may be directed to a box useful for takeout food comprising a base having sidewalls extending therefrom. A box may include a box lid having a top surface and a bottom surface. The box lid may be hingedly connected to one of the base sidewalls, and the box lid may further include foldable flaps extending from the box lid. A plate pocket extending from and attached to an edge of the box lid may also be included, comprising a base with sidewalls extending therefrom, the plate pocket sidewalls extending towards the box lid bottom surface when the box is in an assembled position. The plate pocket may be movable between a closed position wherein an interior portion of the plate pocket is inaccessible to an open position wherein the interior of the plate pocket is accessible. The plate pocket may further comprise at least one tab member for connective mating with at least one opening on the box lid. The plate pocket interior portion may also include plate pocket accessories.

In some aspects, the present invention may also be directed to a box useful for takeout food comprising a base having sidewalls extending therefrom a box lid having a top surface and a bottom surface, the box lid hingedly connected to one of said base sidewalls. The box lid may further include foldable flaps extending from the box lid. A first plate pocket extension member may be hingedly attached to an edge of the box lid, the first plate pocket extension member comprising a first base with sidewalls extending therefrom. A second plate pocket extension member may be hingedly attached to an edge of the box lid opposite the first plate pocket extension member, the second plate pocket extension member comprising a second base with sidewalls extending therefrom. The first and second plate pocket extension members may be movable between a closed position wherein the first and second plate pocket extension members are approximately parallel to the box lid bottom surface and access to an interior portion of the first and second plate pocket extension members is not permitted, to an open position wherein access to the interior portion of the first and second plate pocket extension members is permitted. The first plate pocket extension member may comprise a male or female connecting portion and the second plate pocket extension member may comprise a female or male connecting portion for complementary connection with the male or female connecting portion of the first plate pocket extension member in the closed position. The interior portion of the first and second plate pocket extension members may include plate pocket accessories.

Still, in other aspects the present invention is directed to a method of using a box for holding takeout food comprising providing a box comprising a base having sidewalls extending therefrom, and a box lid having a top surface and a bottom surface. The box lid may be hingedly connected to one of the base sidewalls, and may further include foldable flaps extending therefrom. A plate pocket may be hingedly coupled to an edge of the box lid, the plate pocket including a base with sidewalls extending therefrom, the plate pocket sidewalls extending towards the box lid bottom surface. The method may comprise moving the box from a closed position wherein the lid bottom surface is not accessible to an open position wherein the lid bottom surface, an interior portion of the base, and the plate pocket are exposed, and moving the plate pocket from a closed position wherein an interior portion of the plate pocket including plate pocket accessories is inaccessible to an open position wherein the interior of the plate pocket is accessible. They method may further comprise accessing plate pocket accessories from the interior of the plate pocket.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment(s) of the present invention, reference will be made herein to FIGS. 1-31 of the drawings in which like numerals refer to like features of the invention.

The embodiment(s) shown of the system, apparatus and method for packaging and delivering serving plates along with a pizza is constructed of similar cardboard, plastic and otherwise disposable materials in the same dimensions as an otherwise standard pizza box, sized to fit the size of the pizza being delivered. A standard pizza box base is shown throughout each embodiment, but instead of having a normally plain lid, the lid of the pizza box embodiments of the present invention have built-in a pocket for holding the serving plates for the pizza slices. Because serving plates are normally circular, the pocket shown is also circular as seen in a first embodiment in FIGS. 1-7, although other shapes and configurations may be employed to match the serving plates or other contents of the pocket as shown in the alternate embodiments in FIGS. 8-11 and 12-18, respectively. The width or diameter of the plate pocket is sufficient to accommodate the plate size. In addition to serving plates, napkins and utensils such as forks, knives and spoons may also be provided in the plate pocket.

The pizza box and plate pocket of the embodiments described herein may be constructed of materials including cardboard, paper, wood, plastics, hardboard, chipboard, or any other similar material known in the art which may be of rigid or semi-rigid construction. Thus, the present invention may be constructed of any material which provides a foldable and sturdy construction.

Figure 5:
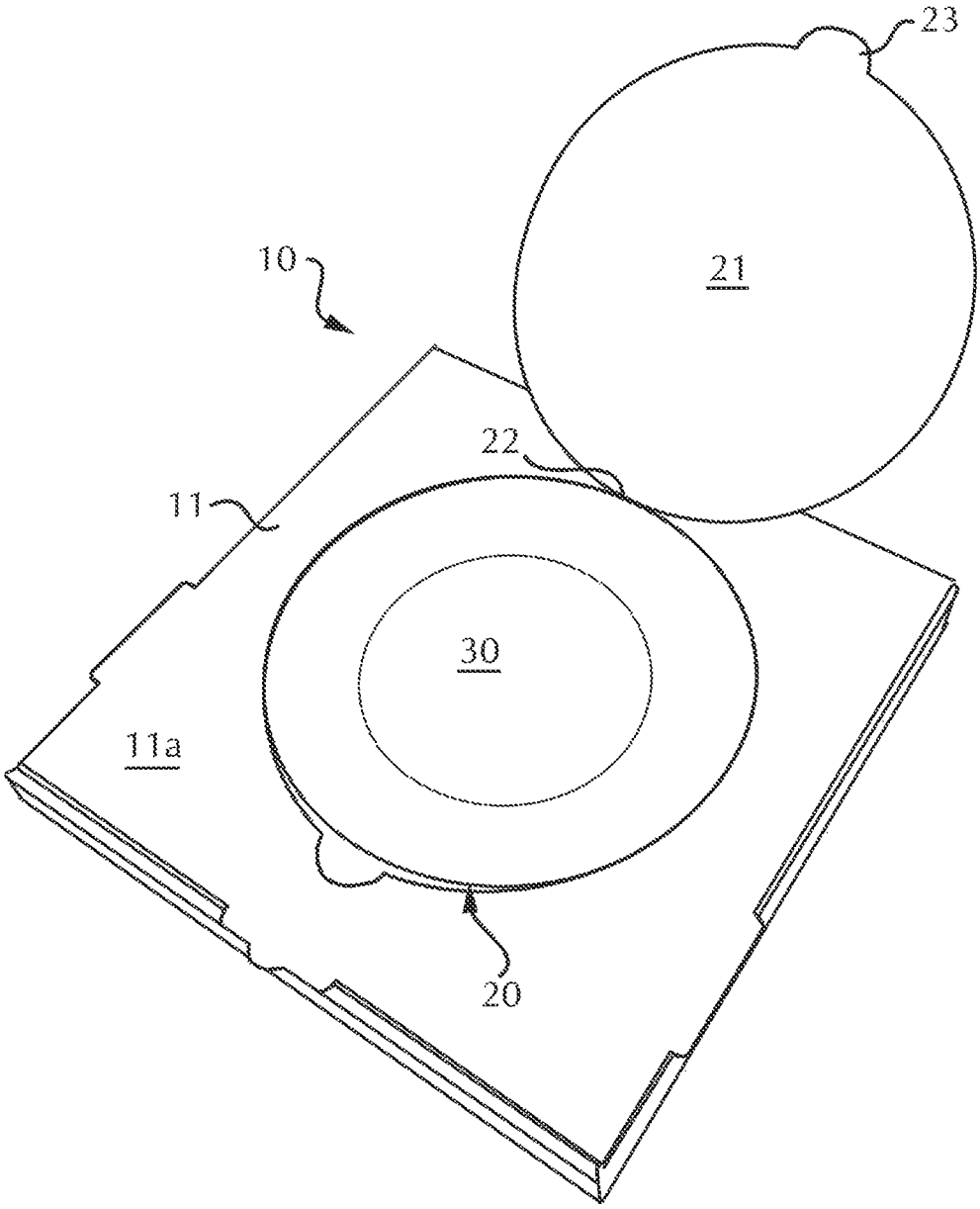
FIG. 5 is a perspective view of the pizza box and plate pocket of FIG. 4, with the lid of the plate pocket in the open position and showing plates disposed within the plate pocket.
Figure 6:
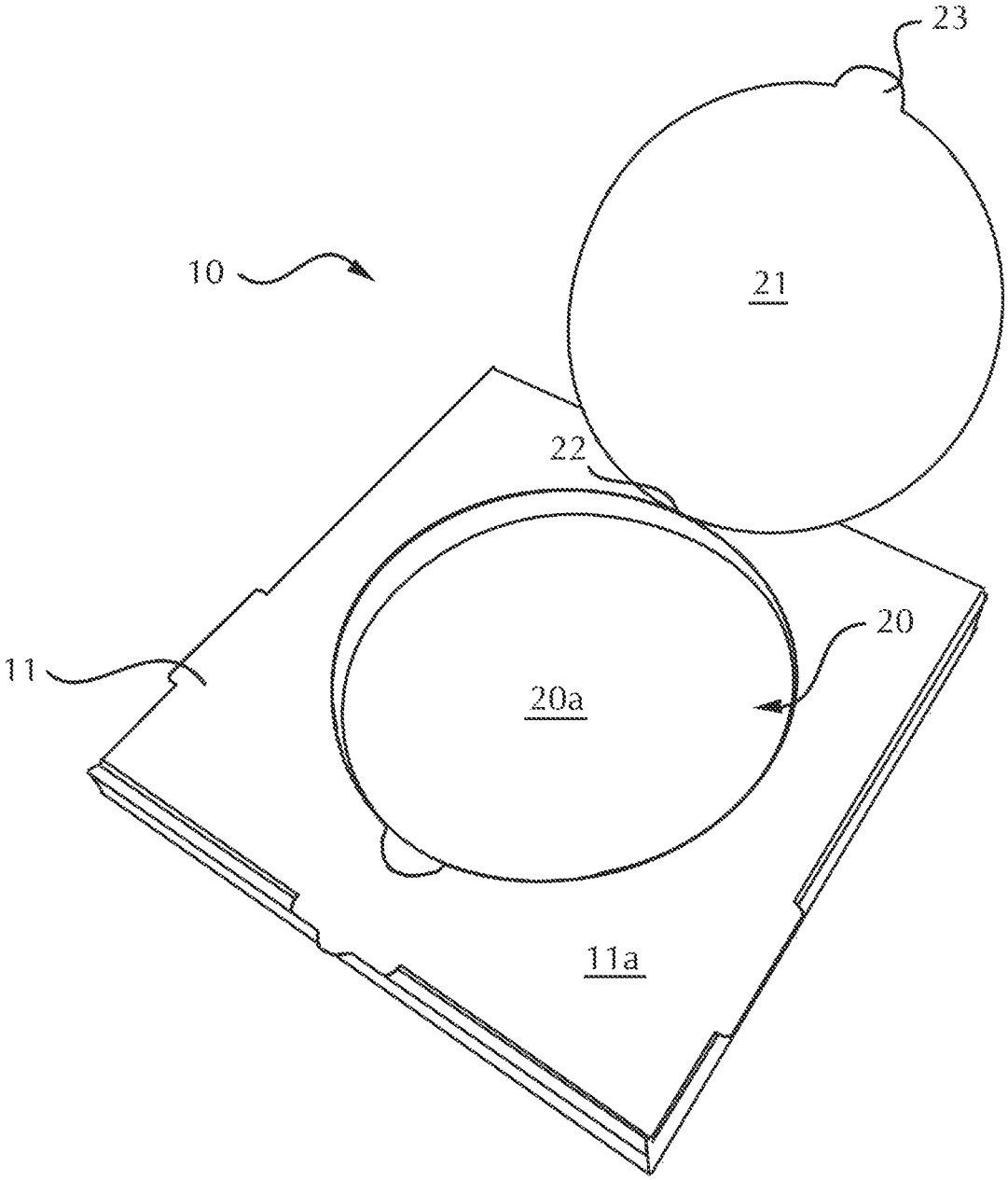
FIG. 6 is a perspective view of the pizza box and plate pocket of FIG. 4, with the lid of the empty plate pocket in the open position.
Figure 7:
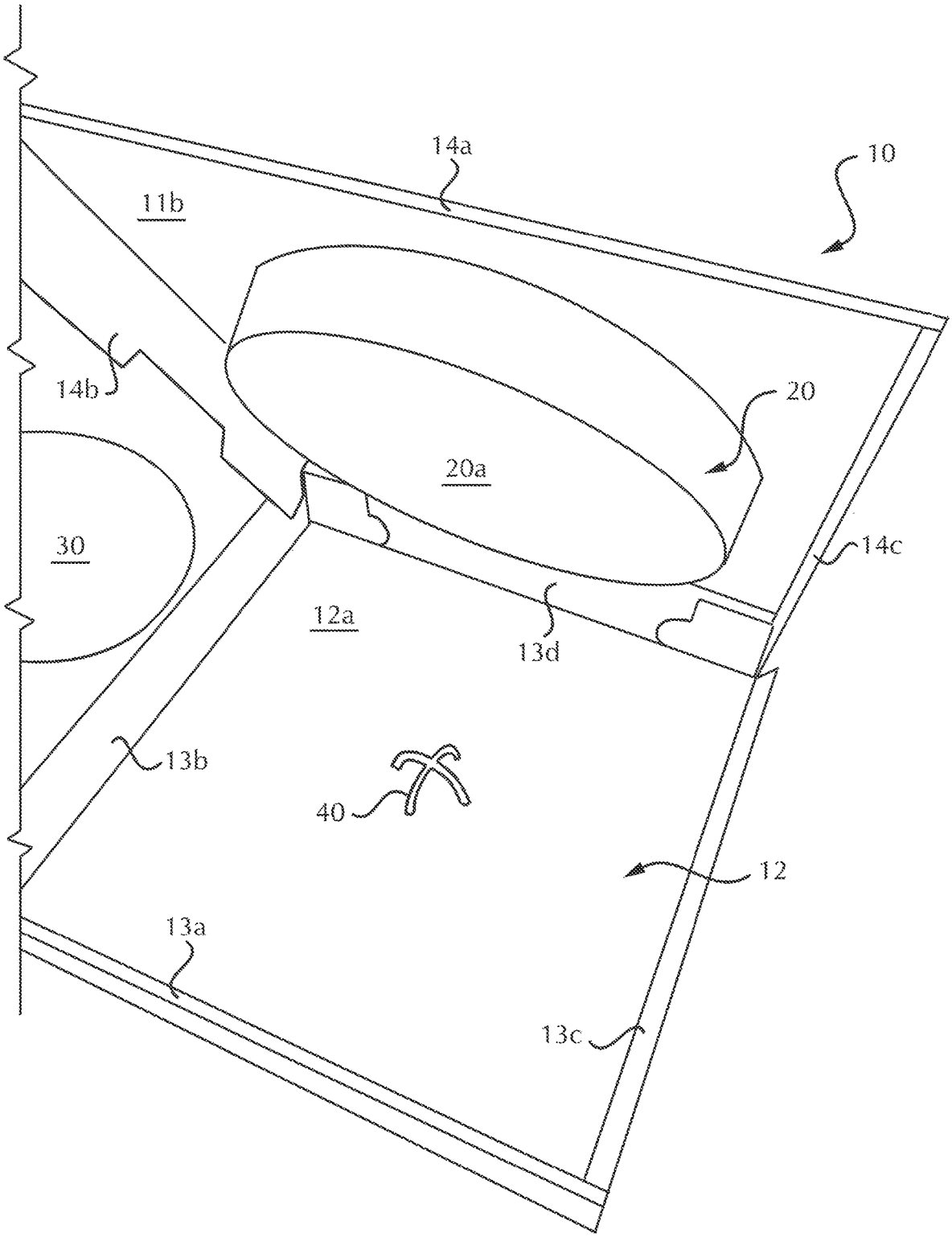
FIG. 7 is a perspective view of the pizza box and plate pocket of FIG. 4, with the lid of the pizza box in the open position.
Figure 8:
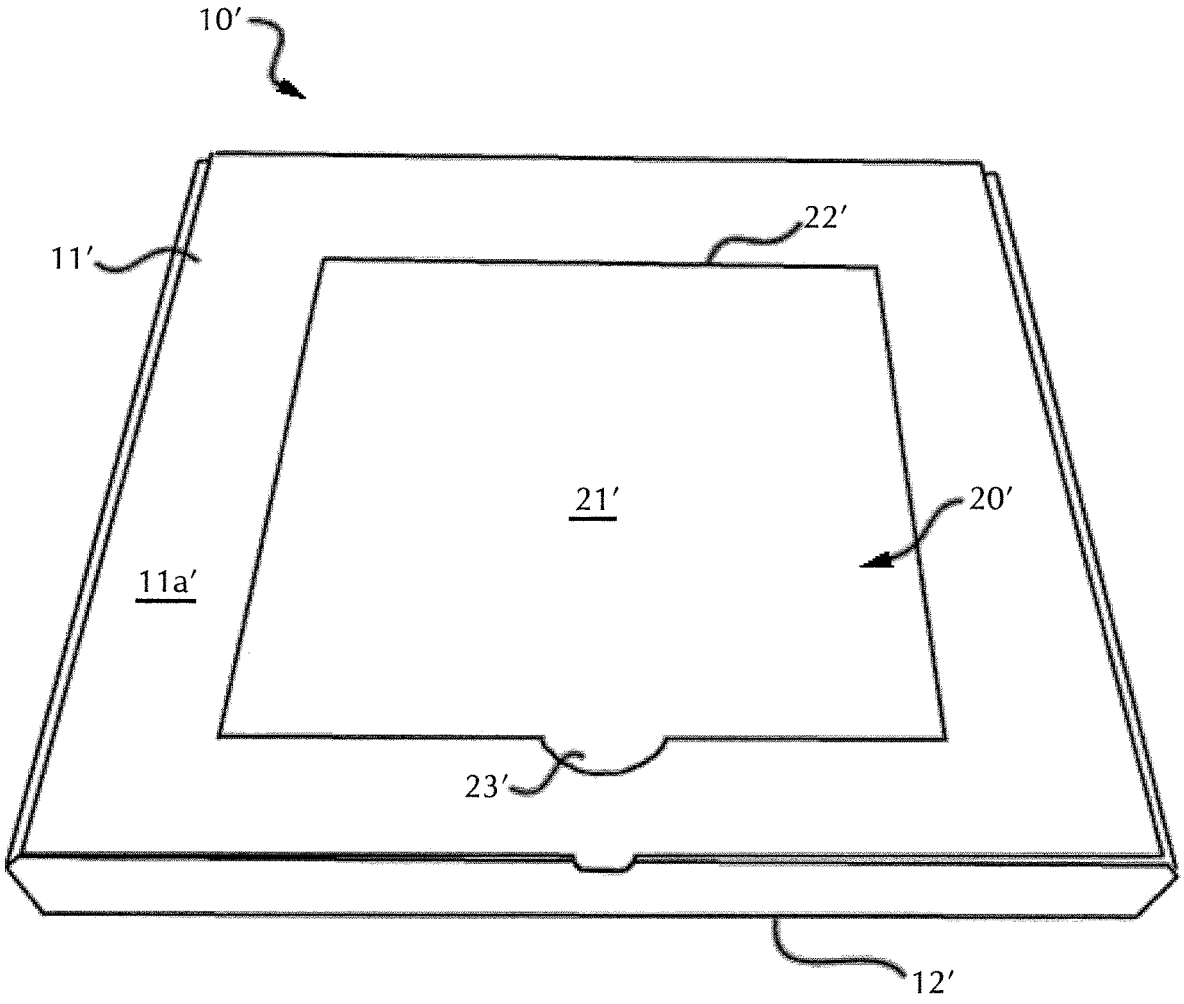
FIG. 8 is a front perspective view of an embodiment of the pizza box and plate pocket of the present invention, with the box lid and pocket lid in the closed positions.
Figure 9:
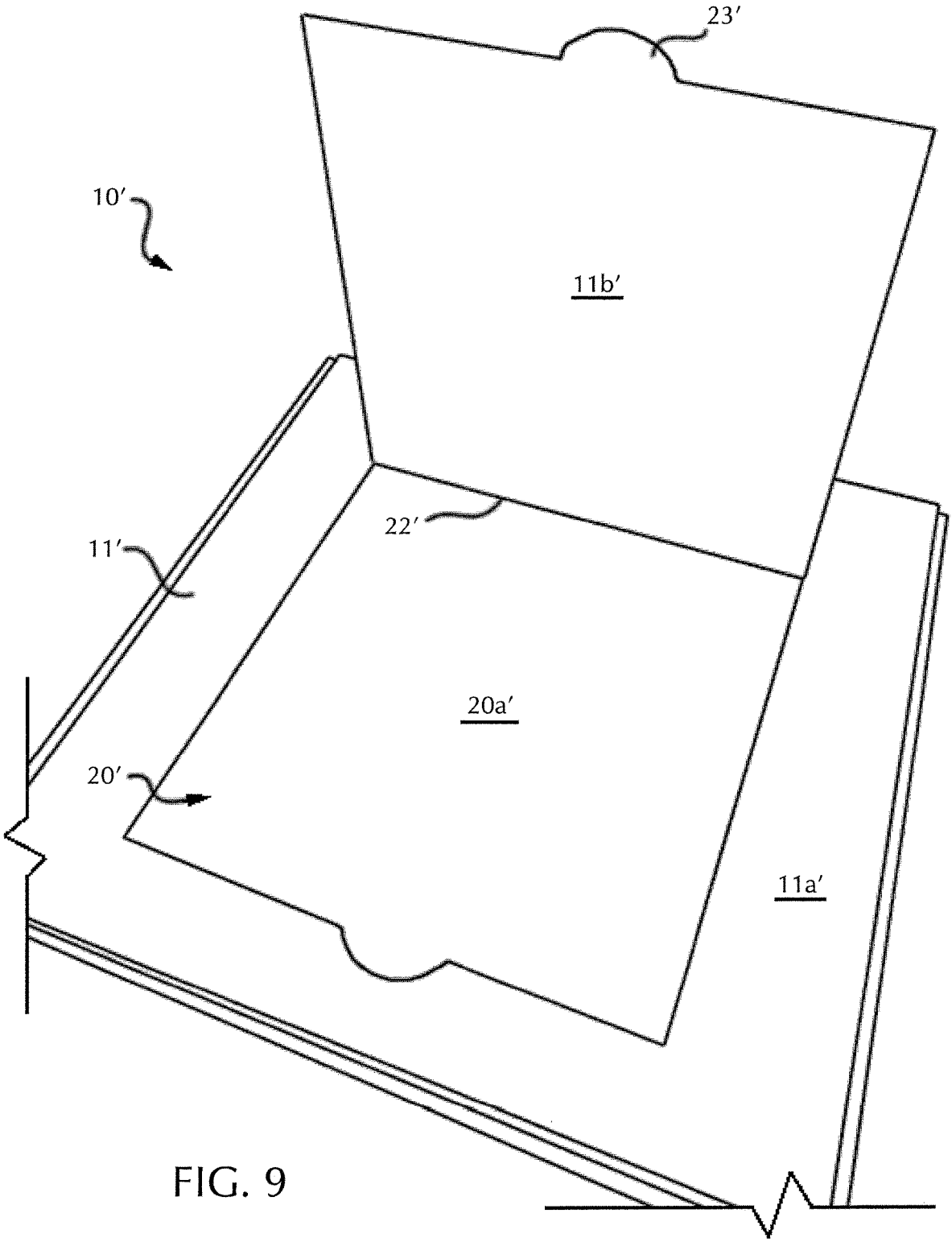
FIG. 9 is a front perspective view of the pizza box and pocket of FIG. 8, with the lid of the empty plate pocket in the open position.

A first embodiment of a pizza box 10 as shown in FIGS. 1-7 has a box lid 11 with a top surface 11*a* and a bottom surface 11*b* facing the inside of the box 10, and a base 12 having a top surface 12*a* facing the inside of the box 10. Box lid 11 includes foldable flaps or flanges 14*a*, 14*b*, 14*c* that extend from the perimeter or edge of the lid 11 and can be folded to extend downwardly from the lid edges. Base 12 includes sidewalls 13*a*, 13*b*, 13*c*, 13*d* extending perpendicular from its edges, with the box lid 11 being connected to sidewall 13*d* as shown in FIG. 7. Foldable flaps or flanges 14*a*, 14*b*, 14*c* of lid 11 nest into and between sidewalls 13*a*, 13*b* and 13*c*. A plate pocket 20 extends downward from the box lid 11 a distance less than the total depth of the pizza box (i.e., from lid bottom surface 11*b* to base top surface 12*a*), so that there is room below a plate pocket bottom or base 20*a* for a pizza 50. Additionally, the diameter of the plate pocket 20 is less than the width dimensions of the interior of the pizza box 10. The pizza 50 will be able to be disposed between the plate pocket base 20*a* and the box base top surface 12*a*.

Figure 4:
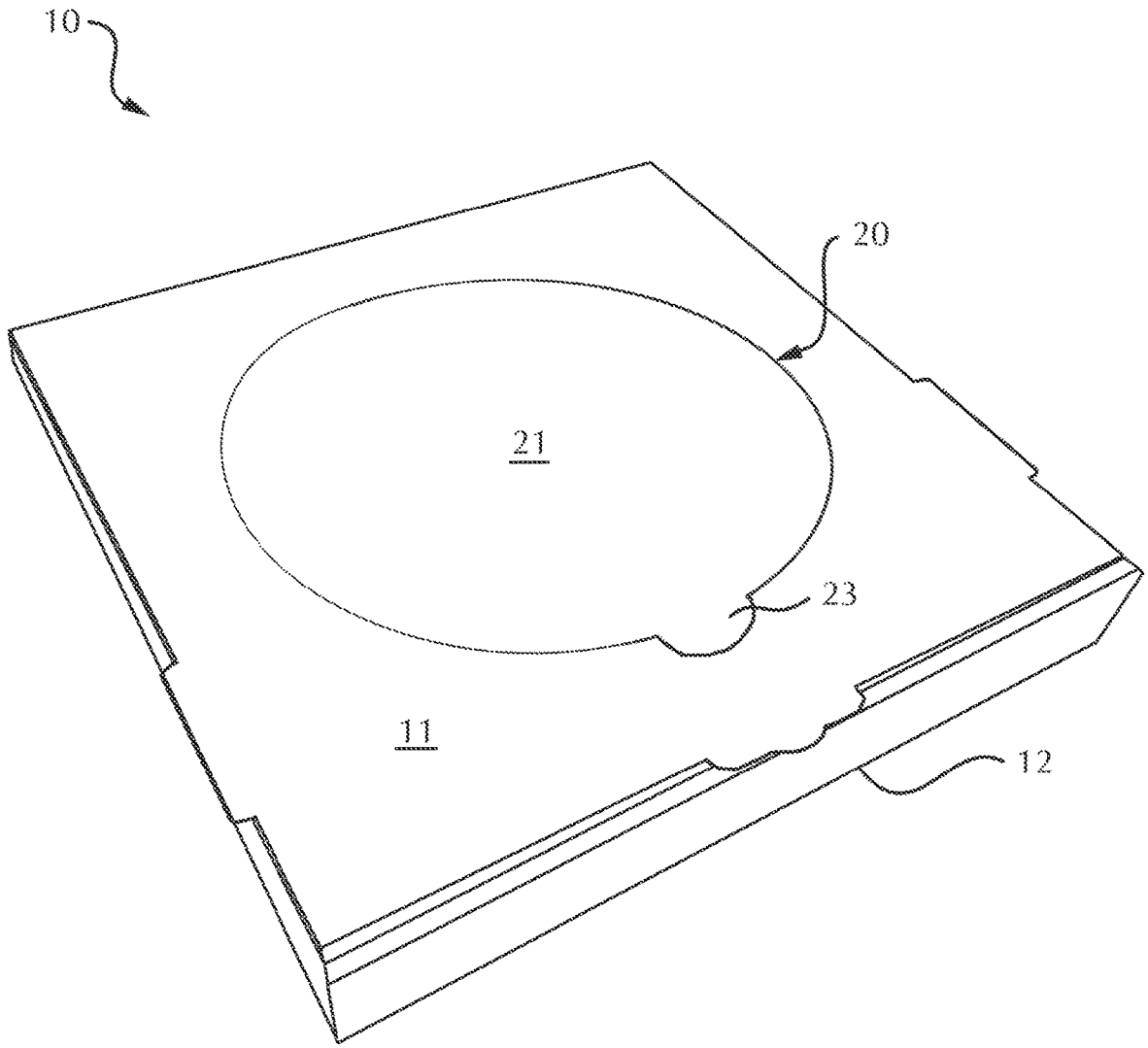
FIG. 4 is a perspective view of an embodiment of the pizza box and plate pocket of the present invention, with the box lid and pocket lid in the closed positions.

A plate pocket lid 21 sits flush with the box top surface 11*a* and is cut or perforated into a substantially ellipse shape, such as that of a circle, or other curved configuration as seen in FIGS. 4-6. At an end of the pocket lid 21 is a lid tab 23 protruding from the pocket lid 21 to provide an end user with an easier grip to open the lid 21. A lid hinge 22 is disposed substantially diametrically opposite from the lid tab 23, and allows the plate pocket lid 21 to be rotatably opened separately from the pizza box lid 11 to provide access to plate pocket accessories 30—which may be plates, utensils, napkins, and the like—that may be disposed within the pocket 20.

Figure 1:
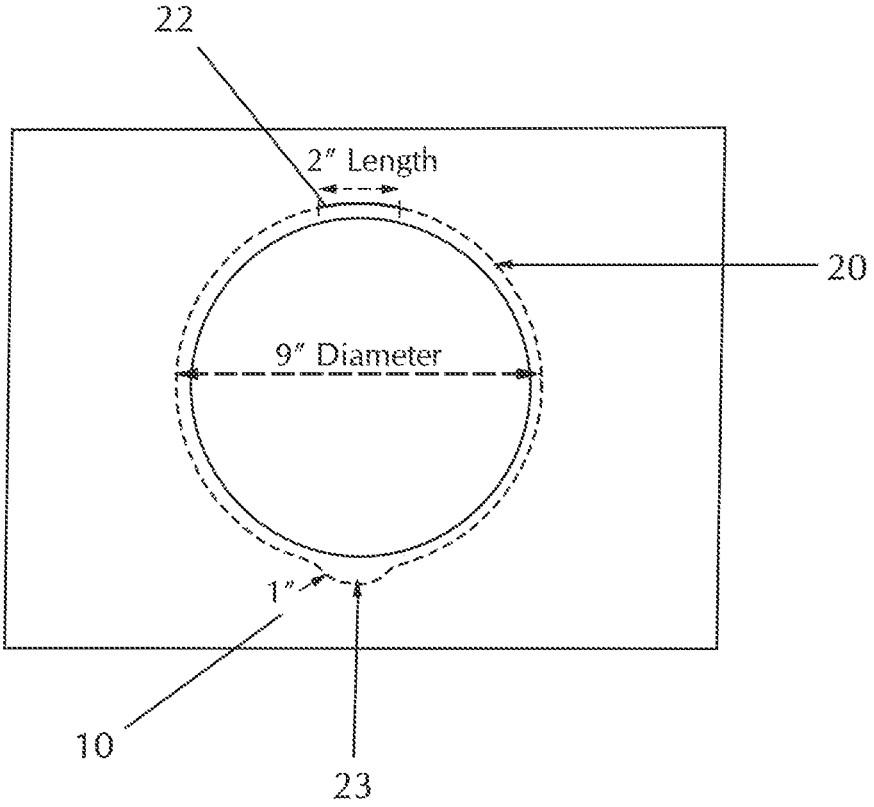
FIG. 1 is a top plan view of an embodiment of the pizza box having the plate holder or pocket in the closed lid of the pizza box, with the cover of the plate pocket in phantom view to show the serving plates stored in the plate pocket.

The plate pocket 20 extends downward from the pizza box lid a distance less than the total depth of the pizza box 10, so that there is room below the plate pocket bottom or base 20*a* for the pizza 50. The depth of the plate pocket will determine the number of plates 30 that may be stacked and secured, and may be about 1 inch in depth, for a typical pizza box depth of 2 inches. The diameter of the plate pocket may be, in the instance of a circular plate pocket as shown in FIG. 1, 9 inches for a standard paper plate, comparable to the diameter of the plate pocket lid. The plate pocket lid 21 is hinged so that the lid 21 may be opened separately from the pizza box lid 11 to access the plates 30. The plate pocket lid 21 may be stamped, cut, or perforated into the pizza box lid 11, except for the plate pocket lid hinge 22, so that the lid material (typically cardboard) serves as a living hinge. The lid tab 23 may be cut into the plate pocket lid 21 substantially opposite the lid hinge 22 so that a user can grasp it to open the pocket lid 21. The sides and bottom that make up the plate pocket body may be made of any suitable material, such as cardboard or plastic, and secured to the bottom surface 11*b* of the pizza box lid 11 below the plate pocket lid 21, for example, by adhesive or adhesive tape. The plate pocket body extends at its side edges to the bottom surface 11*b* of the pizza box lid 11. The paper, plastic or otherwise disposable serving plates 30 may be loaded into the plate pocket 20 before the plate pocket 20 is secured to the bottom surface 11*b* of the pizza box lid 11. Alternatively, the plates 30 may be loaded into the plate pocket 20 by opening the pocket lid 21 and inserting the plates through the opening in the pizza box lid 11*a*.

Figure 10:
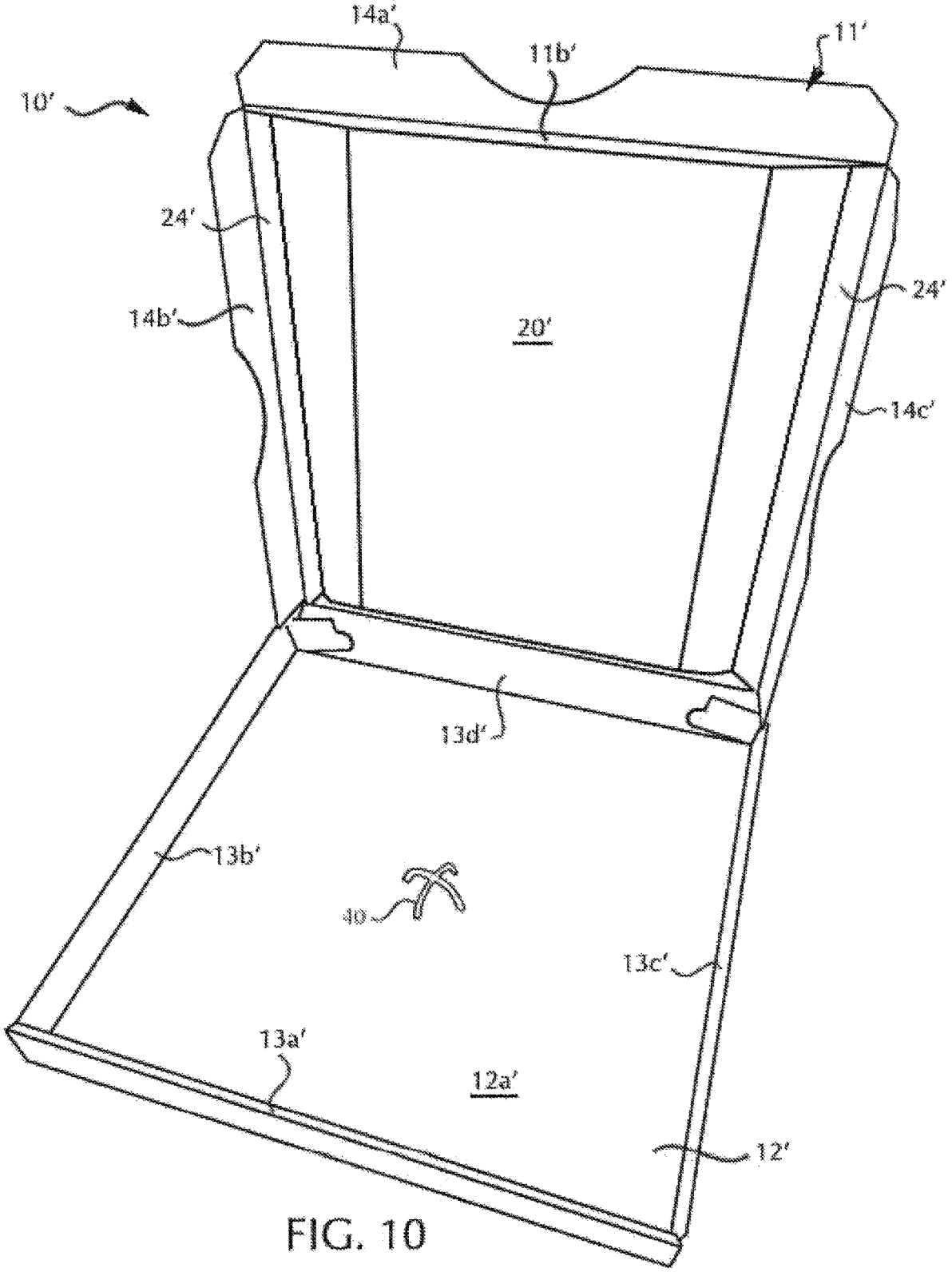
FIG. 10 is a front perspective view of the pizza box and pocket of FIG. 8, with the lid of the pizza box in the open position.

A second embodiment of the pizza box 10' shown in FIGS. 8-11 has a box lid 11' with a top surface 11*a*' and a bottom surface 11*b*' facing the inside of the box 10', and a base 12' with a top surface 12*a*' facing the inside of the box 10'. Box lid 11' includes foldable flaps or flanges 14*a*', 14*b*', 14c' that extend from the perimeter or edge of the lid 11' and can be folded to extend downwardly from the lid edges. Base 12' includes sidewalls 13a', 13b', 13e, 13d' extending perpendicular from its edges, with the box lid 11' being connected to sidewall 13d' as shown in FIG. 10. Foldable flaps or flanges 14a', 14b', 14c' of lid 11' nest into and between sidewalls 13a', 13b' and 13c'. A plate pocket 20' extends downward from the lid 11a' distance less than the total depth of the pizza box (i.e., from lid bottom surface 11b' to base top surface 12a'), so there is room below a plate pocket bottom or base 20a' for the pizza. The edges of the plate pocket 20' extend to the bottom surface 11b' of the pizza box lid 11', and connecting flaps 24' may be provided at the plate pocket edges to adhere the plate pocket to either bottom surface 11b' (stopping at the flaps or flanges 14b', 14c'), or to the downwardly extending flaps or flanges 14b', 14c' of lid 11' as shown in FIG. 10. The pizza 50 will be able to be disposed between the plate pocket base 20a' and the box base top surface 12a'.

A plate pocket lid 21' sits flush with the box top surface 11a' and is cut, stamped, or perforated into a parallelogram. At an end of the pocket lid 21' is a lid tab 23' protruding from the pocket lid 21' to provide an end user with an easier grip to open the lid 21'. A lid hinge 22' is disposed substantially opposite from the lid tab 23', and allows the plate pocket lid 21' to be rotatably opened separately from the pizza box lid 11' to provide access to the plate pocket accessories 30—which may be plates, utensils, napkins, and the like—that may be disposed within the pocket 20'.

Figure 11:
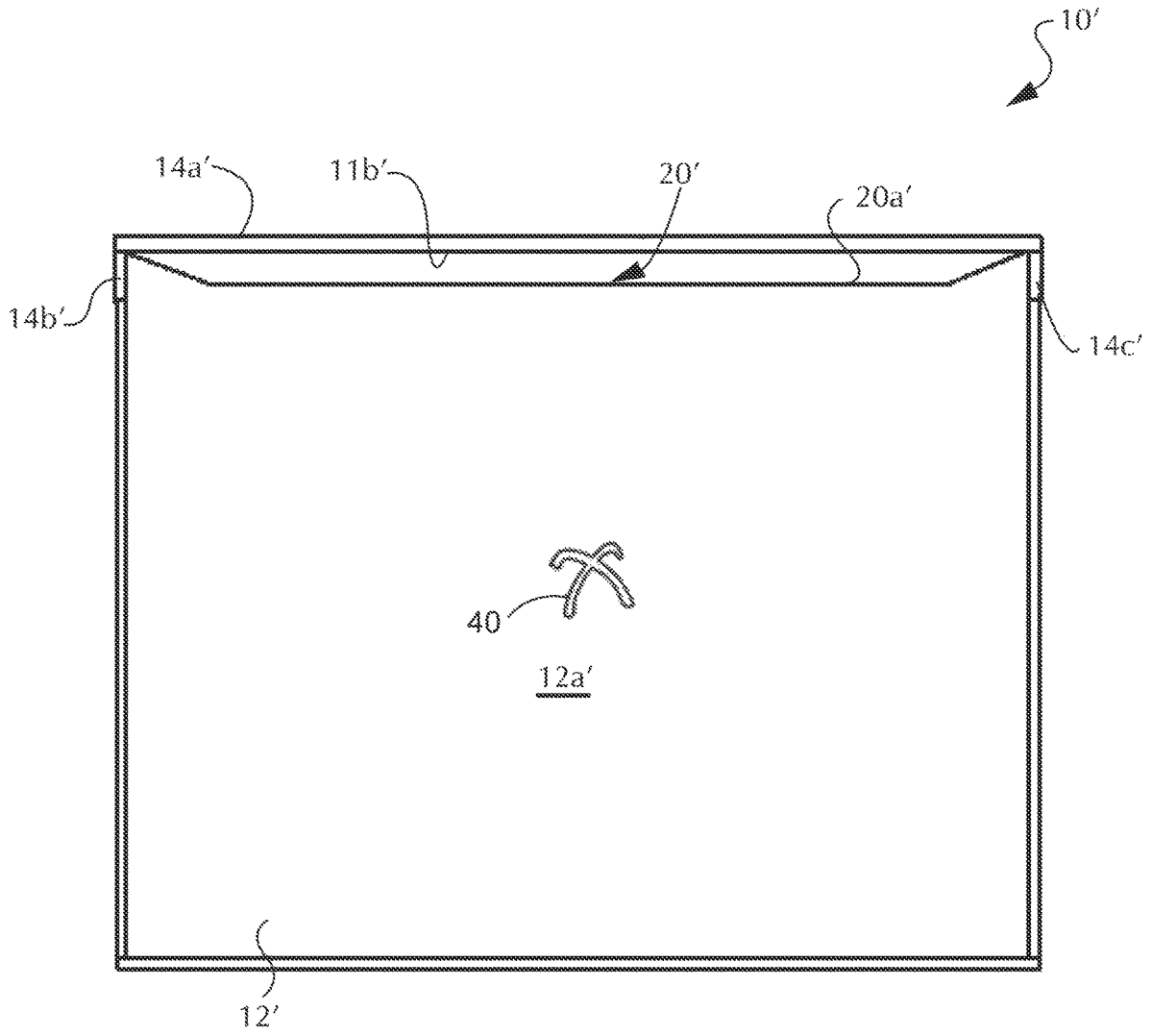
FIG. 11 is a top-down view of the pizza box and pocket of FIG. 8, with the lid of the pizza box open at a 90° angle such that the view is looking directly down into the opening of the plate pocket.
Figure 12:
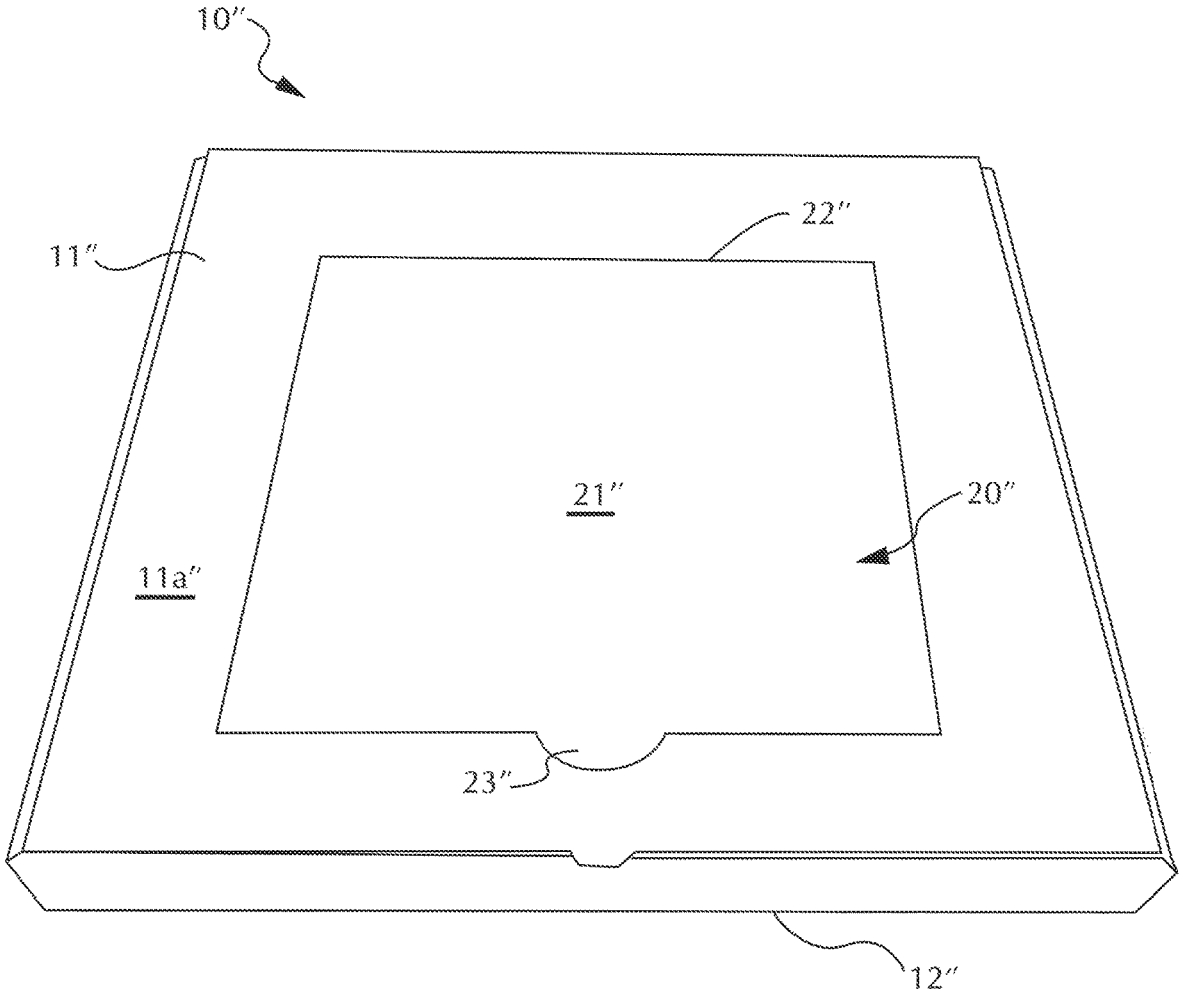
FIG. 12 is a front perspective view of an embodiment of the pizza box and plate pocket of the present invention, with the box lid and pocket lid in the closed positions.
Figure 13:
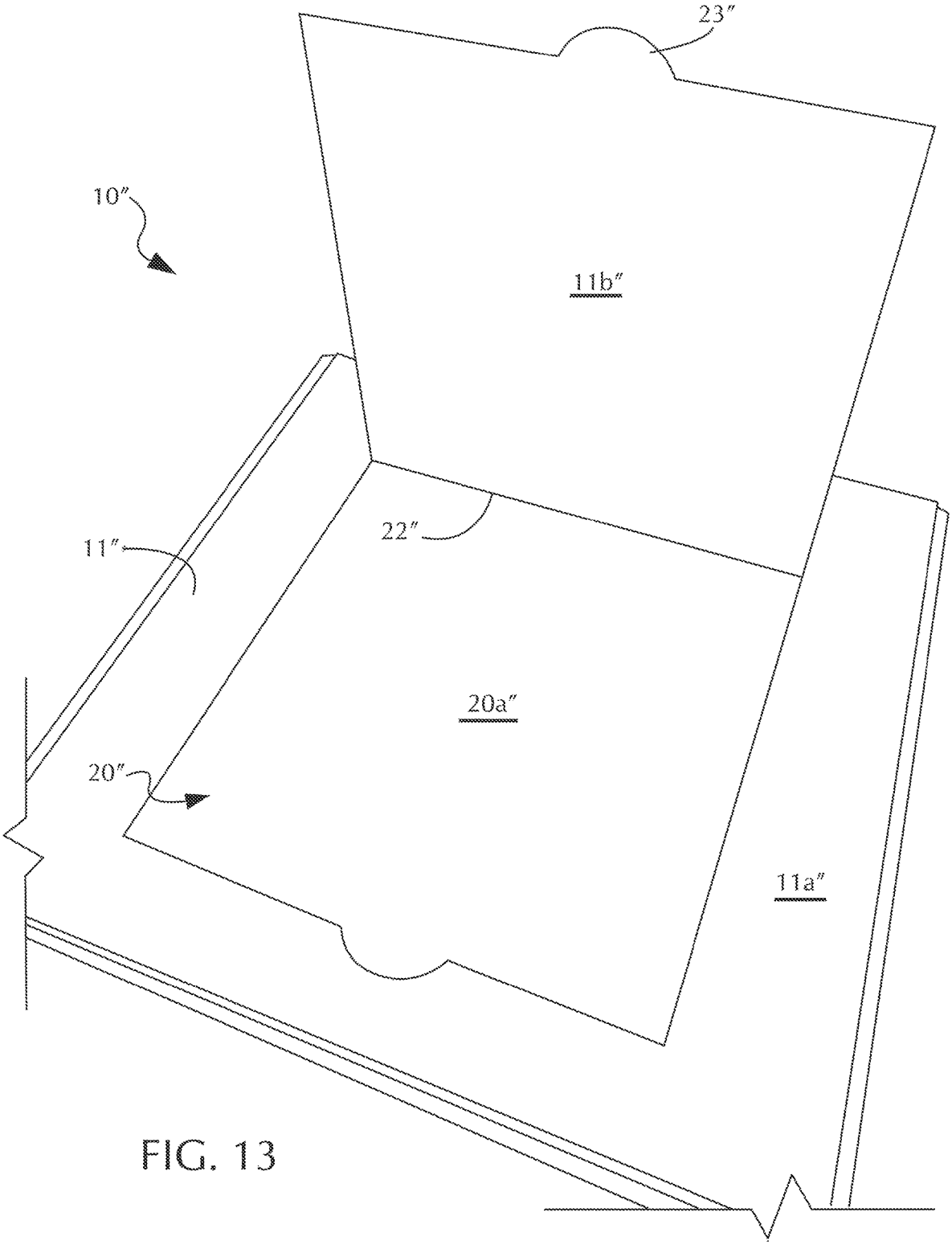
FIG. 13 is a front perspective view of the pizza box and pocket of FIG. 12, with the lid of the empty plate pocket in the open position.

The plate pocket base 20a' may expand to cover substantially the entirety of the box lid bottom surface 11b', as shown in FIG. 10. Plates 30 may be inserted into the pocket 20' either by opening the pocket lid 21' and inserting the plates through the opening created in the box lid 11', or by opening the box lid 11' and inserting the plates into the pocket 21' through the gap between the box lid bottom surface 11b' and pocket plate base 20a', as shown in FIG. 11.

The dimensions of the plate pocket lid 21' may be, for example, a 12 in. by 12 in. square, with the pocket lid tab 23' extending at about a ¾ in. length and about a 2 in. width from an edge of the pocket lid 21'. These dimensions are presented merely as examples and should not be interpreted as limiting the present invention as described herein. Other dimensions of the plate pocket 20' and pocket lid 21' may be used to accommodate plate pocket accessories 30 of varying dimensions and/or quantities that may be desirable to insert into the pocket 20'.

Figure 14:
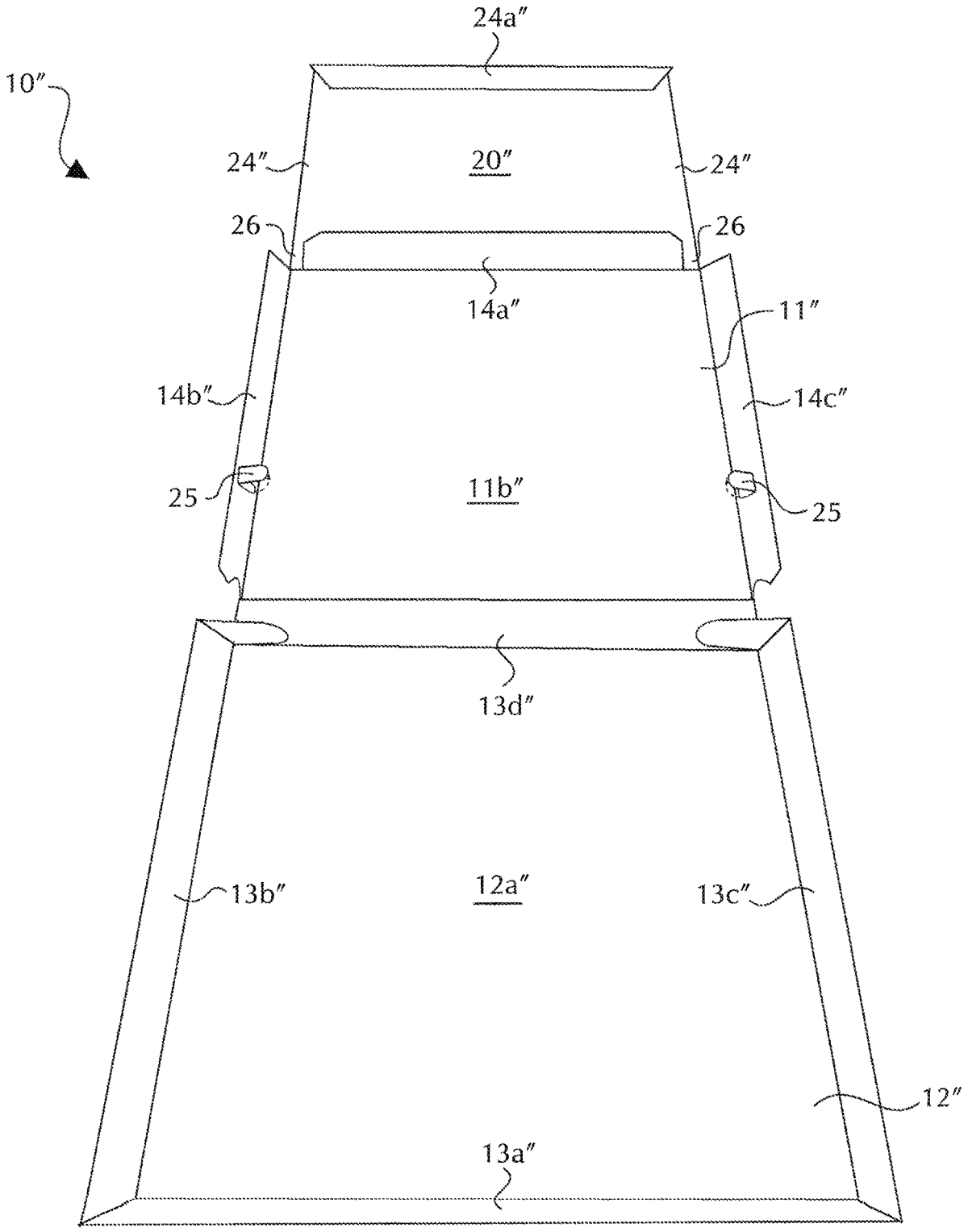
FIG. 14 is a top-down perspective view of the unassembled pizza box of FIG. 12.
Figure 15:
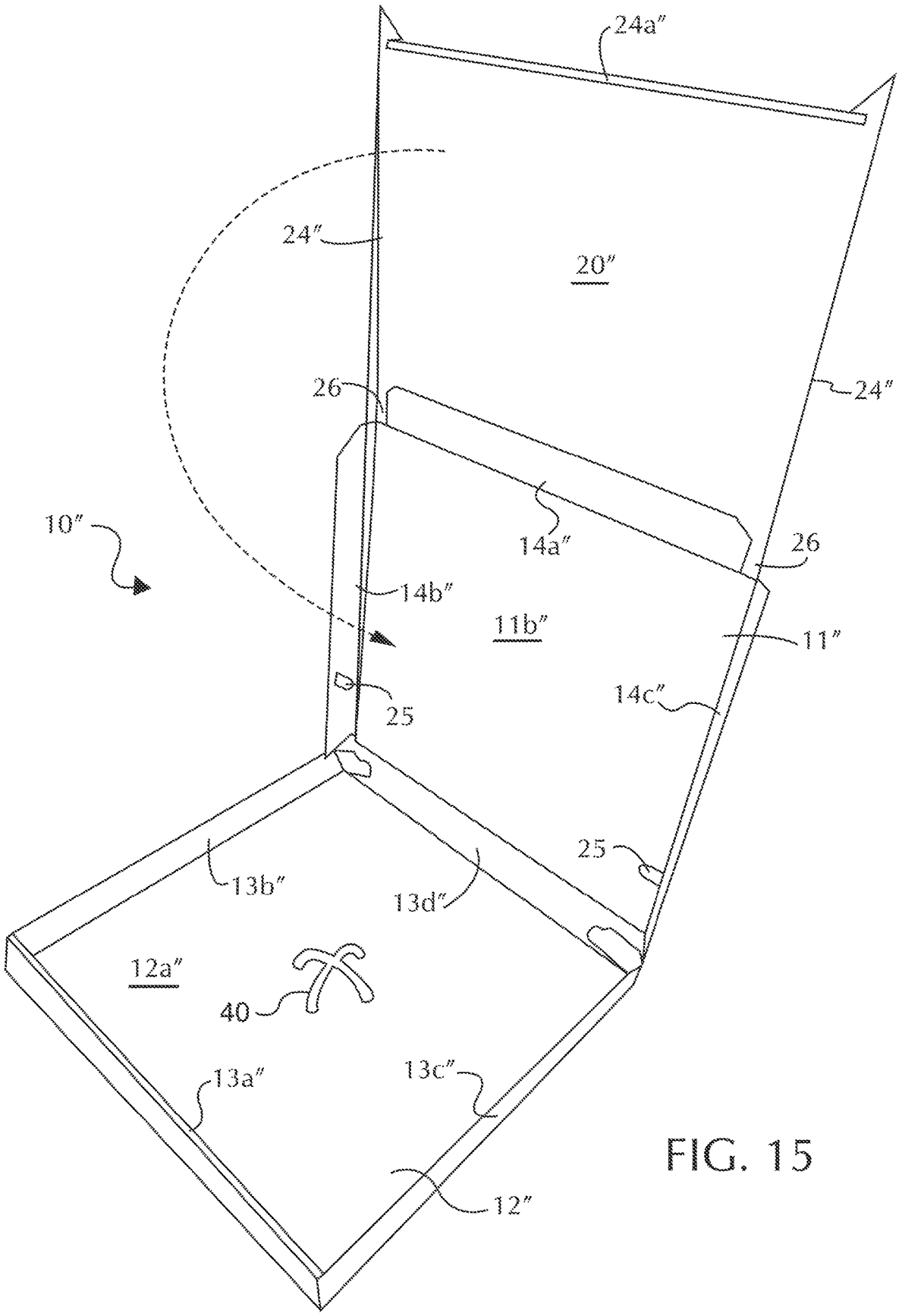
FIG. 15 is a side perspective view of the unassembled pizza box of FIG. 12, showing the folding action of the plate pocket as shown by the arrow.
Figure 16:
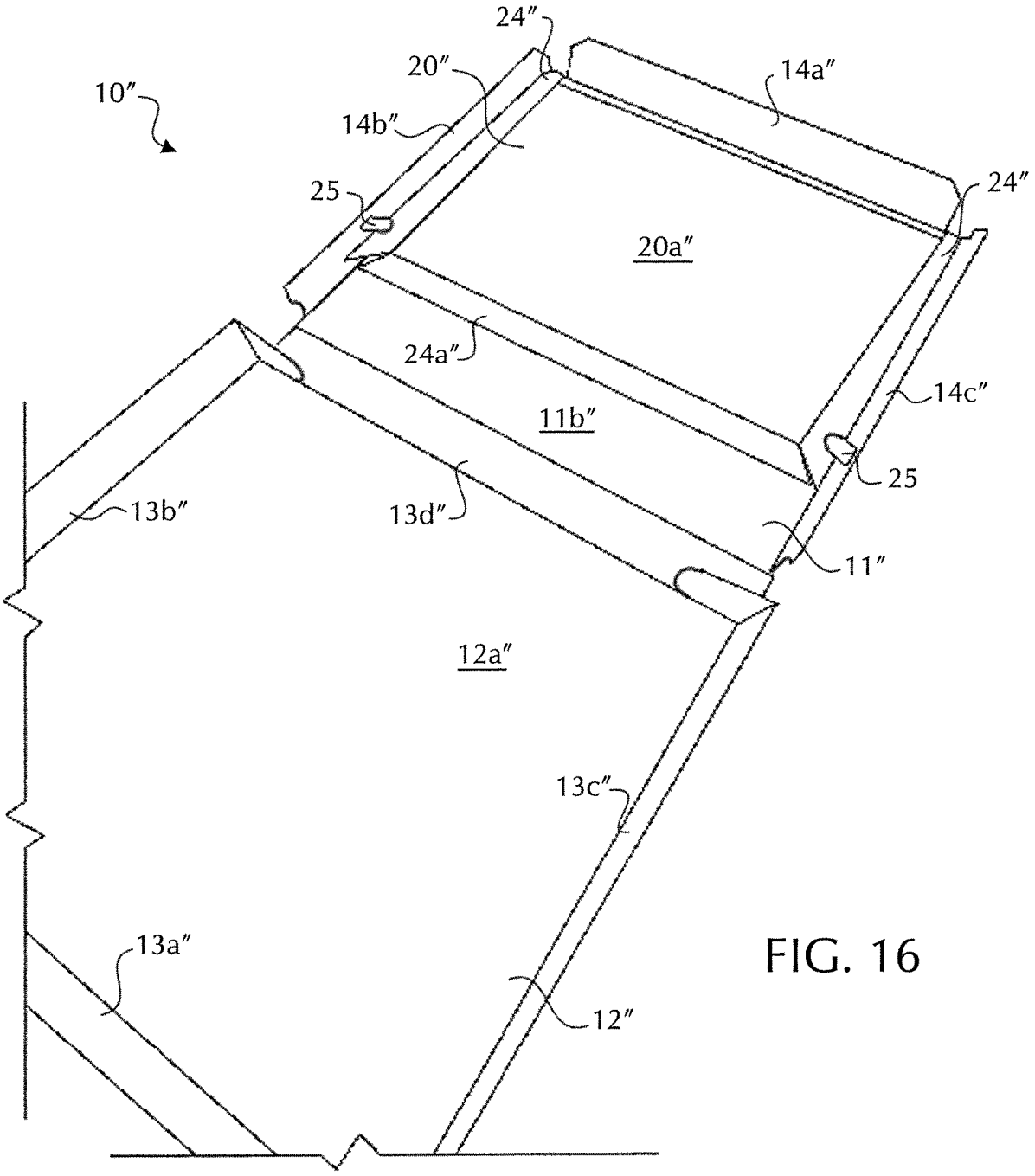
FIG. 16 is a side perspective view of the opened, assembled pizza box of FIG. 12, showing the plate pocket folded into place and the pocket top flap closed.

A third embodiment of the pizza box 10" shown in FIGS. 12-16 has a box lid 11" with a top surface 11a" and a bottom surface 11b' facing the inside of the box 10", and a base 12" with a top surface 12a" facing the inside of the box 10". Box lid 11" includes foldable flaps or flanges 14a", 14b", 14c" that extend from the perimeter or edge of the lid 11" and can be folded to extend downwardly from the lid edges. Base 12" includes sidewalk 13a", 13b", 13c", 13d" extending perpendicularly from its edges, with the box lid 11" being connected to sidewalls 13d" as shown in FIGS. 14-16. Foldable flaps or flanges 14a", 14b", 14c" of lid 11" nest into and between sidewalk 13a", 13b", and 13c". A plate pocket 20" extends downward from the lid 11a" a distance less than the total depth of the pizza box (e.g., from lid bottom surface 11b" to base top surface 12a") once the box 10" is assembled, so there is room below a plate pocket bottom or base 20a" for the pizza. The edges of the plate pocket 20" may extend to the bottom surface 11b" of the pizza box lid 11", and pocket flaps 24" may rest at the plate pocket edges either at bottom surface 11b", or to the downwardly extending flaps or flanges 14b", 14c", of lid 11" once the box 10" is assembled, as shown in FIG. 16. The pizza will be able to be disposed between the plate pocket base 20a" and the box base top surface 12a".

A plate pocket lid 21" sits flush with the box top surface 11a" and is cut, stamped, or perforated into a parallelogram. At an end of the pocket lid 21" is a lid tab 23" protruding from the pocket lid 21" to provide an end user with an easier grip to open the lid 21". A lid hinge 22" is disposed substantially opposite from the lid tab 23", and allows the plate pocket lid 21" to be rotatably opened separately from the pizza box lid 11" to provide access to the plate pocket accessories 30—which may be plates, utensils, napkins, and the like—that may be disposed within the pocket 20". The shape and dimensions of plate pocket 20" and pocket lid 21" should not be interpreted as being limited to the parallelogram shapes depicted in FIGS. 12-16, as they can be formed in any other shape suitable for manufacturing needs (e.g., in an ellipse shape as previously disclosed in FIGS. 1-7).

The plate pocket 20" is connected to, and acts as an extension of the lid 11" when the box 10" is unassembled. Foldable flap 14a" is cut into the body of pocket 20" such that flap 14a" will separate and disconnect from the pocket 20" when the pocket is folded into the interior (e.g., underneath lid 11" to contact lid bottom surface 11b", as shown by the arrow in FIG. 15), but remain attached to the lid 11". Connecting members 26 extend from pocket 20" adjacent to pocket flaps 24" and straddle each side of foldable flap 14a" so as to keep the plate pocket 20" connected to the lid 11" edge. This configuration thus allows the box 10" of the present invention to be assembled from one continuous and partially cut/perforated sheet of cardboard (or other boxing material).

Lid flaps 14b" and 14c" further comprise at least one projection 25 partially cut into each flap, respectively, such that they may be pushed out from the walls of flaps 14b", 14c" and rotate or swivel inwards (as shown by the arrows in FIG. 14). Once the pocket 20" is folded underneath the lid 11" (such that the pocket base 20a" and lid bottom surface 11b" are substantially parallel to each other), projections 25 may then be pushed or popped inwards (e.g., inside of the box 10") to rest on the base 20a" of the pocket 20", forming a detent mechanism to hold the plate pocket 20" in place, as shown in FIG. 16. This projection structure thus allows for the plate pocket 20" to be installed within box 10" without necessitating the need for glue or other adhesives to hold the pocket (and corresponding plates/napkins/utensils disposed therein) within the box, and further prevent it from contacting the pizza.

Pocket flaps 24" may further be folded inward prior to folding the pocket 20" into the lid 11". Doing so will create a barrier within the pocket 20" such that plates, napkins, and/or utensils may remain secure within the pocket once they are inserted. A top pocket flap 24a" is also foldable into the pocket to act as a barrier, but may be done so after the pocket 20" is folded underneath the lid and held in place by the projections 25. Plates, napkins, and/or utensils may be placed within the pocket 20" through the opening created by the un-folded top pocket flap 24a", and later secured by folding said flap 24a" into place (e.g., towards lid bottom surface 11b"). Thus, the pizza box 10" of the present invention presents two different manners in which plates, napkins, and/or utensils may be loaded into the plate pocket either through the open pocket lid after the box and plate pocket is assembled, or through the plate pocket gap as described above.

Figure 17:
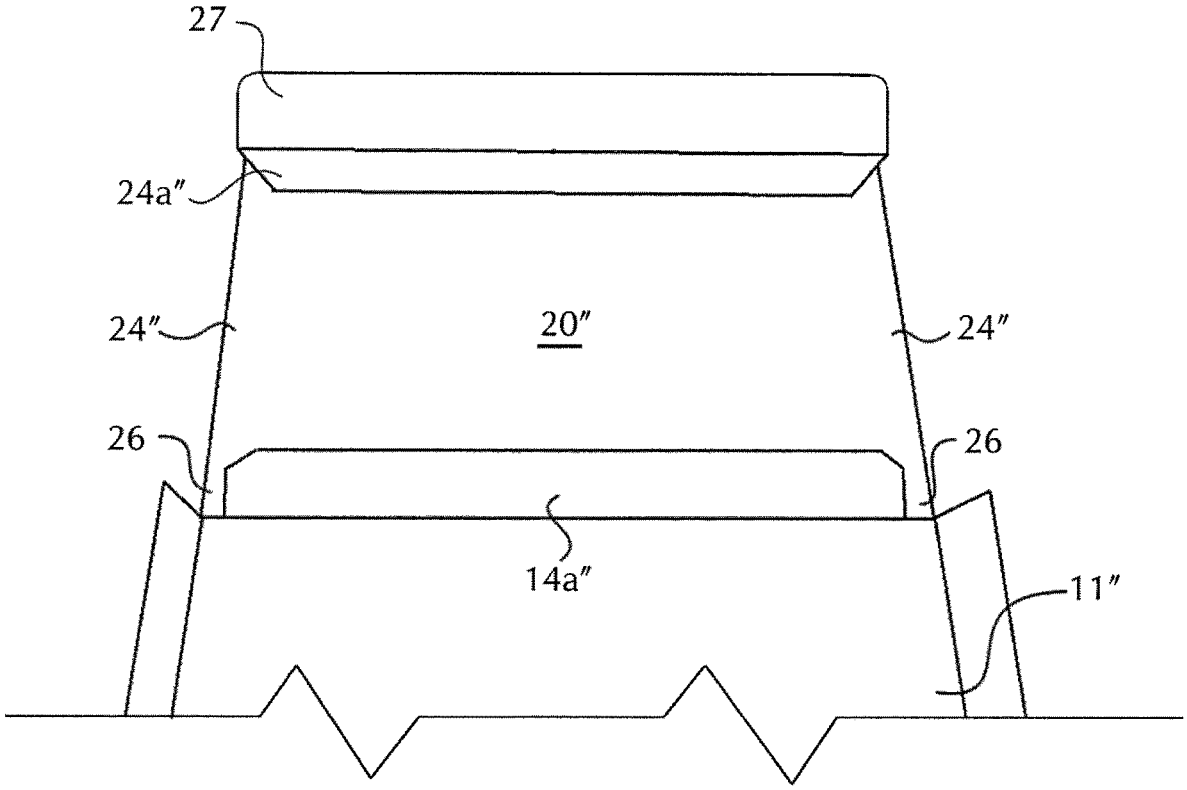
FIG. 17 is a partial, top-down view of the unassembled pizza box and pocket of FIG. 12, showing a foldable extension disposed on a top flap of the plate pocket.
Figure 18:
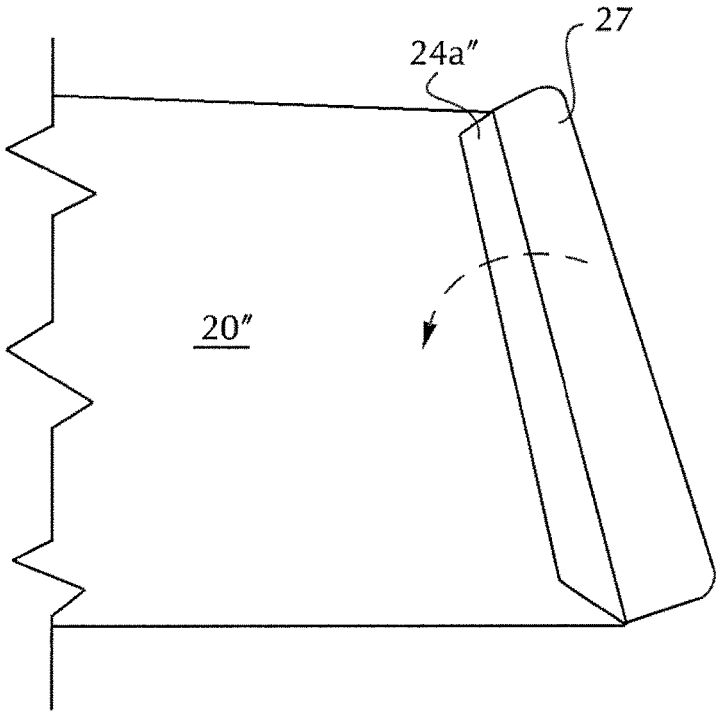
FIG. 18 is a partial side view of the unassembled pizza box and pocket of FIG. 12, showing the folding action of the plate pocket top flap foldable extension of FIG. 17.

In an embodiment, the top pocket flap 24*a*" may further include a foldable extension 27 connected to and extending from the top edge of top flap 24*a*", as shown in FIGS. 17-18. This foldable extension acts as an extra support to ensure the plates, napkins, and/or utensils stay within the pocket 20" once they are placed inside the assembled box. As the top flap 24*a*" is folded into place, the extension 27 is further folded past the angle of top flap 24*a*" (the folding action shown by the arrow in FIG. 18), such that the extension 27 is disposed substantially parallel to the lid bottom surface 11*b*" once the pocket 20" is folded into position. End users may still pull the top pocket flap 24*a*" and extension 27 away from the pocket 20" after it is folded into place, so as to expose the inside of the pocket and use the opening to insert more plates, napkins, and/or utensils as needed.

The dimensions of the pizza box 10" may present a preferably 14 in.$^2$-22 in.$^2$ box (i.e., base top surface 12*a*" dimensions), or any other dimensions necessary to fit irregular sized pizzas (e.g., small, medium, large, extra-large, party size, sheet, etc.), with the length and width independently varying between 14 in.-22 in. The base 12" sidewalls 13*a*", 13*b*", 13*c*", 13*d*" may have a height ranging from 1 in.-3 in., or any other height needed to fit irregular sized pizzas (e.g., deep-dish, Chicago style, etc.). The lid 11" may have dimensions conforming to those of the base dimensions, preferably 14 in.$^2$-22 in.$^2$, or any other dimensions necessary to fit irregular sized pizzas. The plate pocket 20" may share similar dimensions, having a width equivalent to that of the lid 11" (i.e., 14 in.-22 in.) and a height slightly less than the lid height (i.e., 14 in.-22 in.). The plate pocket dimensions may also vary to fit irregular sized plates, napkins, utensils, etc.

The downwardly extending flaps or flanges 14*a*", 14*b*", 14*c*" of lid 11" may have a height of 1 in.-3 in., generally conforming to the height of base 12" sidewalls 13*a*", 13*b*", 13*c*", 13*d*". The length of flaps 14*b*", 14*c*" will be equivalent to that of the lid height (i.e., 14 in.-22 in.), and the length of flap 14*a*" will be equivalent to that of the lid width (i.e., 14 in.-22 in.). The at least one projection 25 may be disposed 1 in.-4 in. from the bottom edge of flaps 14*a*" and/or 14*b*" (measuring from flap bottom edge to closest edge of the at least one projection 25), and ½ in.-1½ in. from the flap side edge to the connecting portion of the at least one projection 25 (i.e., the swivel point of the projection 25; where it is connected to the flaps 14*a*" and/or 14*b*"). The at least one projection 25 itself may have a width between ½ in.-1½ in. The plate pocket 20" may have dimensions preferably between 10 in.$^2$-18 in.$^2$, or any other dimensions necessary to fit irregular sized plates, napkins, and/or utensils, with the height and width of the plate pocket independently varying between 10 in.-18 in. The dimensions of the plate pocket 20" will depend on the dimensions of the lid 11", such that the plate pocket may properly be cut into the lid 11" without compromising the lid integrity.

The connecting members 26 of the plate pocket may have a width between 1 in.-3 in., measured from the edge of pocket flaps 24" to the edge of lid flap 14*a*". The top pocket flap 24*a*" may have a height between ½ in.-2 in., or any other measurement as needed to accommodate larger/smaller stacks of plates, napkins, etc.

Figure 2:
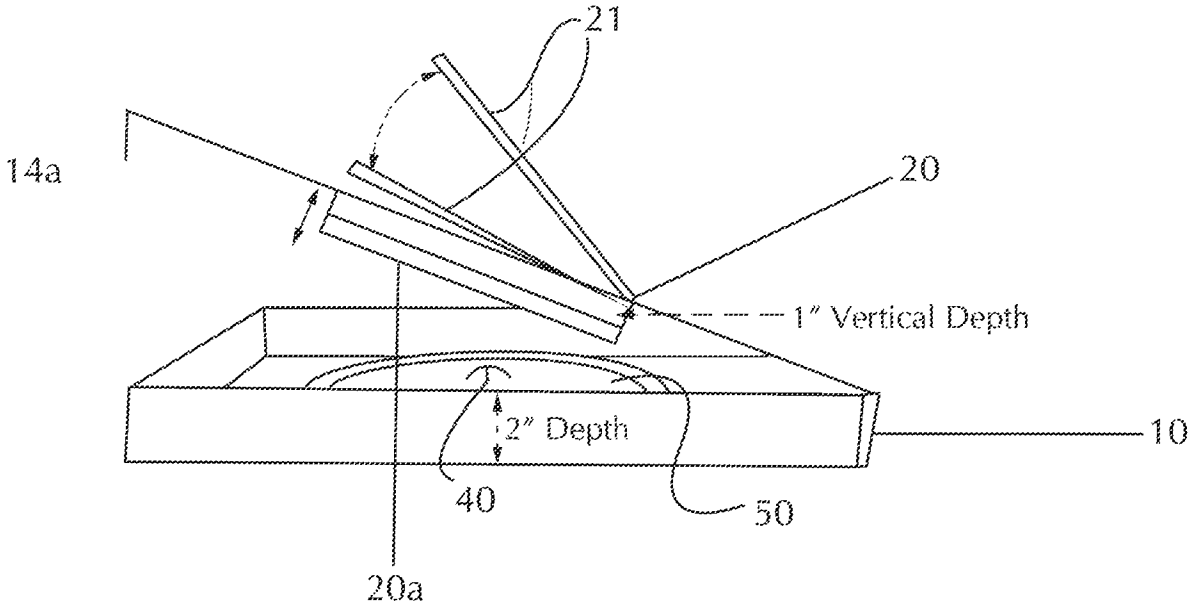
FIG. 2 is a side view, partially in perspective, of the pizza box of FIG. 1 with the pizza box lid partially open, and a side elevational view of the plate pocket extending downward from the pizza box lid, and the plate pocket cover in various stages of opening.
Figure 3:
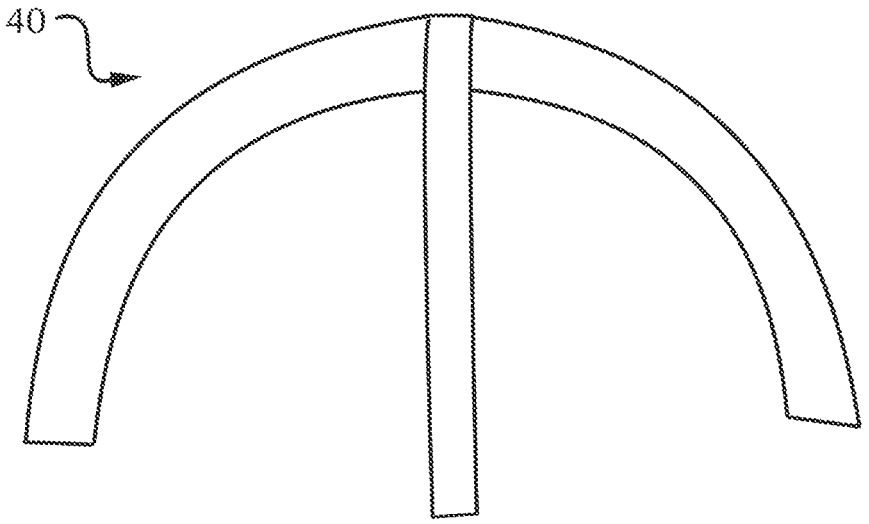
FIG. 3 is a front perspective view of the pizza separator or bumper shown in FIG. 2.

To keep proper separation of the pizza from the base 20*a*, 20*a*', 20*a*" of the plate pocket 20, 20', 20", a pizza separator or bumper 40 is employed. In the embodiment shown in FIG. 3, the pizza separator or bumper 40 has four curved legs extending outwardly in a cross-pattern and down from an upper connection point. In side view the legs have a downward concave configuration. The bumper 40 is placed in the pizza box after the pizza is inserted into the box 10, 10', 10" such that the bumper 40 legs rest on top of the pizza, and the upper point contacts and supports the plate pocket base 20*a*, 20*a*', 20*a*". The total height of the pizza separator or bumper is the difference between the depth of the plate pocket 20, 20', 20" and the height of the pizza box 10, 10', 10", which may be about 1 inch as shown in FIG. 2. The legs may be made of plastic, for example, having a thickness of about ⅛ inch. The pizza box of the present invention may be made with the pizza box lid 11, 11', 11" integral with the pizza box base 12, 12', 12", and using the same folded side templates employed in otherwise conventional pizza boxes, and may be shipped to the restaurant unfolded for assembly when needed, in the manner now typically used.

Figure 19:
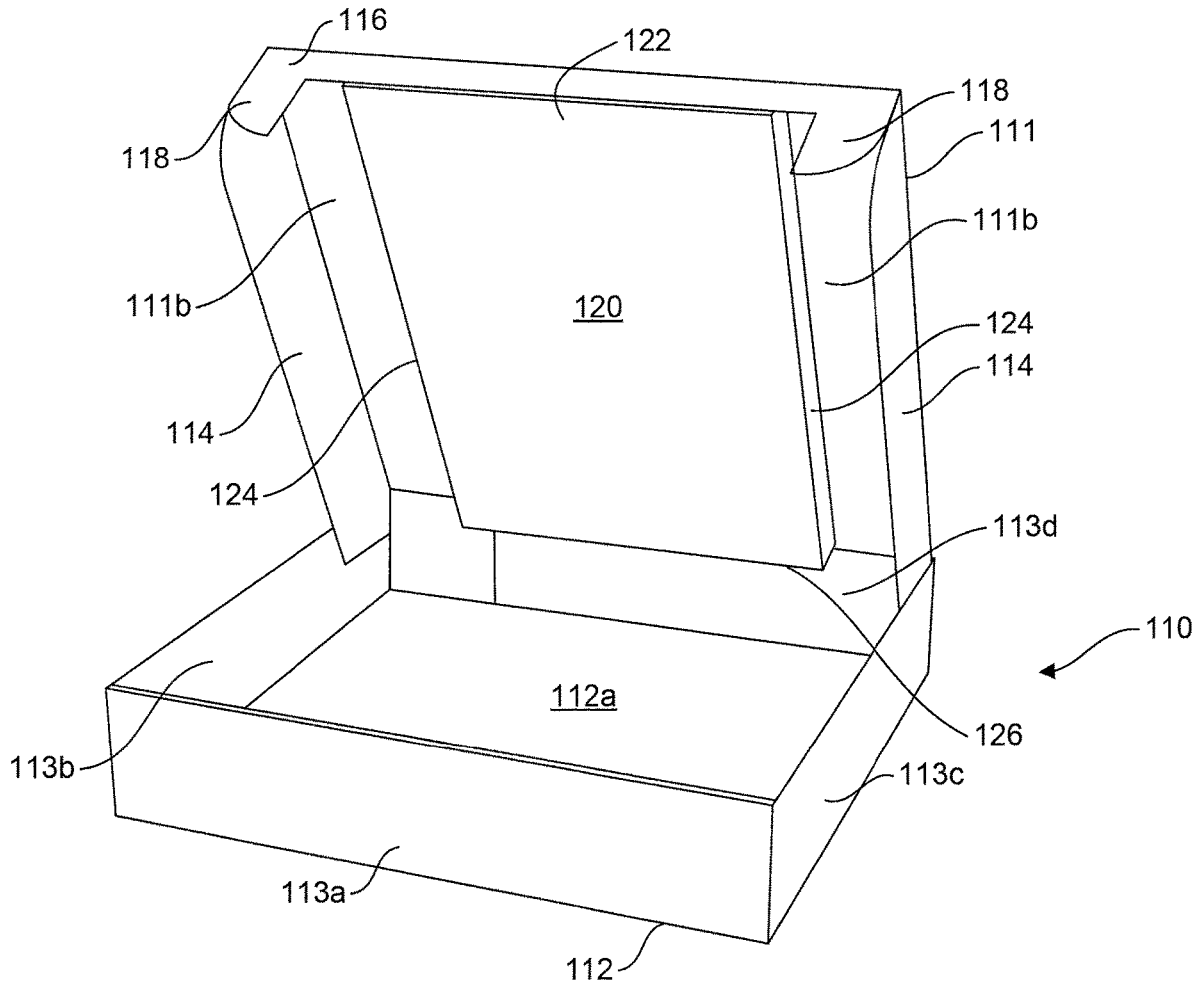
FIG. 19 is a perspective view of an embodiment of the pizza box and plate pocket of the present invention, with the box lid in the open position.

Further embodiments of the present invention can be seen in FIGS. 19-20, 26-27, and 30. As depicted, pizza box 110 has a box lid 111 with a bottom surface 111*b* facing the inside of the box 110, and a base 112 having a top surface 112*a* facing the inside of the box 110. Box lid 111 includes foldable flaps or flanges 114 that extend from the perimeter or edge of the lid 111 and can be folded to extend downwardly from the lid edges. Base 112 includes sidewalls 113*a*, 113*b*, 113*c*, 113*d* extending perpendicular from its edges, with the box lid 111 being connected to sidewall 113*d* as shown in FIG. 19. Foldable flaps or flanges 114 nest into and between sidewalls 113 when the box lid 111 is in the closed position. A plate pocket 120 extends downward from the box lid 111 to form a cavity separate from the pizza box interior for placement of plate pocket accessories such as plates, napkins, utensils, and the like that may be disposed within the interior cavity 121 of the plate pocket 120. Access to such the plate pocket accessories within the pocket may be achieved in a similar manner to those of any of the previous embodiments described herein.

Figure 20:
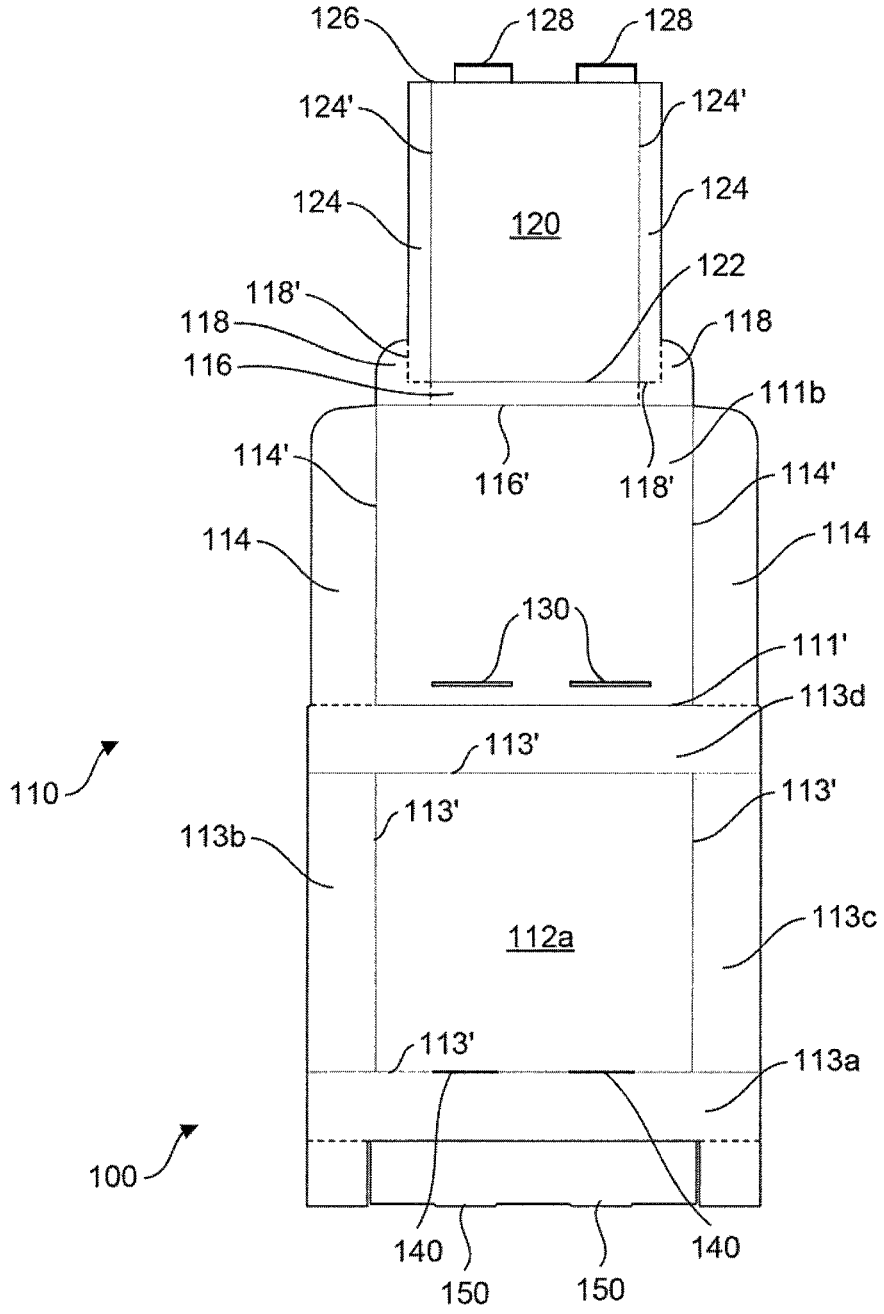
FIG. 20 is a top plan view of an unassembled pizza box and plate pocket of FIG. 19.
Figure 21:
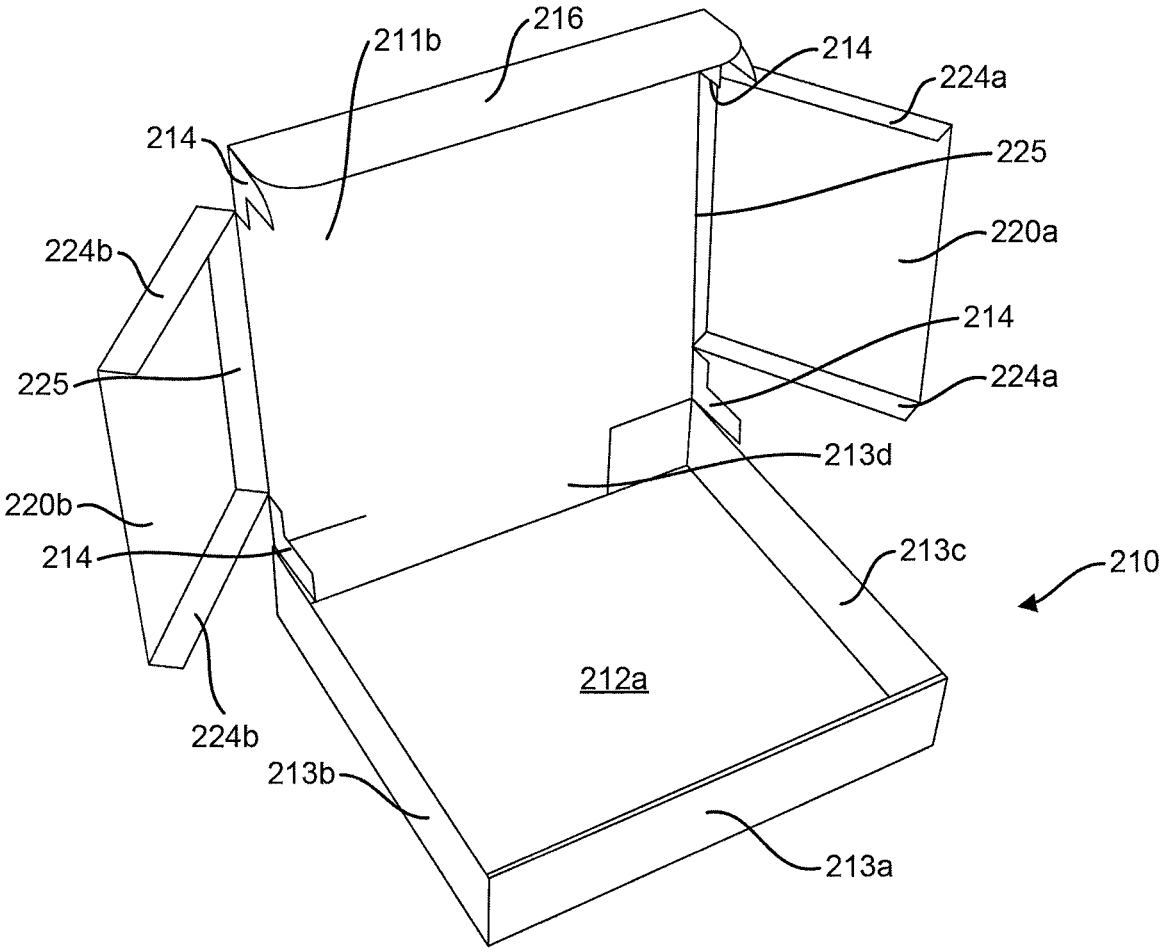
FIG. 21 is a perspective view of an embodiment of the pizza box and plate pocket of the present invention, with the box lid in the open position and plate pocket in the unassembled position.

Plate pocket 120 includes foldable sidewalls 124 which extend towards the inner lid surface 111*a* when the box is in an assembled position, such as the view seen in FIG. 19. In the unassembled version depicted in FIG. 20, plate pocket 120 may be hingedly coupled to the box lid 111 via forward plate pocket sidewall 116. During assembly, Plate pocket 120 may be folded along upper plate portion 122, subsequently releasing locking extension portions 118, which may be nested into and between sidewalls 113 when the box lid 111 is in the closed position. To provide increased structural stability of the plate pocket 120, a plate pocket connecting portion 126 may include one or more tab members 128 for connective mating with one or more openings 130 in the box lid 111. While the one or more tab members 128 depicted in the exemplary view of FIG. 20 are shown disposed on connecting portion 126, tab members may be disposed along plate pocket sidewalls 124, and in any amount necessary, and lid openings 130 may be located on the box lid 111*a* in any position to ensure a complementary mating location between the opening(s) and tab member(s) when the pizza box is in the assembled position such that plate pocket 120 is properly secured.

Optionally, access to plate pocket accessories within the plate pocket cavity 121 may be accomplished without need for perforated cuts on the lid to form the plate pocket lid as described in the aforementioned embodiments. Rather, in some embodiments, a user may hingedly open the pizza box lid when the box is in the closed position, thereby exposing the base top surface 112*a*, plate pocket 120, and lid bottom surface 111*a*. Upon separating the connection between the plate pocket to the lid bottom surface such as by releasing tab member 128 from opening 130, removal of an adhesive, tap, or the like, the user may move the plate pocket 120 to an open position, thereby exposing the loaded plate pocket accessories within the plate pocket cavity 121.

Further embodiments of the present invention, like those depicted in FIGS. 21-25, 28-29, and 31, may be utilized incorporating a plate pocket 220 formed by a plurality of extension members 220*a*, 220*b* for access to plate pocket accessories such as plates, napkins, utensils, and the like stored within the plate pocket in accordance with the pizza box designs of the previous embodiments. Similar to the pizza box of the previous embodiments, pizza box 210 comprises a box lid 211 with a bottom surface 211*b* facing the inside of the box 210, and a base 212 having a top surface 212*a* facing the inside of the box 210. In the unassembled view of FIG. 25, pizza box 210 is depicted having plate extension members 220*a*, 220*b* disposed on the sidewall portions 214 of the box lid 211 which may be folded inward towards lid bottom surface 211*b*. In some embodiments, extension members 220*a*, 220*b* may overlap one another upon folding of the plate pocket peripheral wall 225 which is proximate sidewall portions 214 towards the interior portion of bottom surface 211*b*. In such embodiments, the extension members 220*a*, 220*b* may be secured via an adhesive such as glue or tape to form plate pocket 220, which may contain plates or any other utensils/napkins within the plate pocket interior 221 formed by plate pocket sidewalls 224*a*, 224*b* which may be folded towards the bottom surface 211*b*.

After assembly of the pizza box 220, foldable flap portions 214 will remain extending from the perimeter or edge of the lid 211 and can be folded to extend downwardly from the lid edges, and may be nested into and between sidewalls 213*a-d* when the box lid 211 is in the closed position. Lid top surface 216, which extends from the perimeter or edge of the lid 211, may also be folded to extend downwardly from the lid edges, nesting within and between the sidewalls of the pizza box 210 in the closed position.

Figure 22:
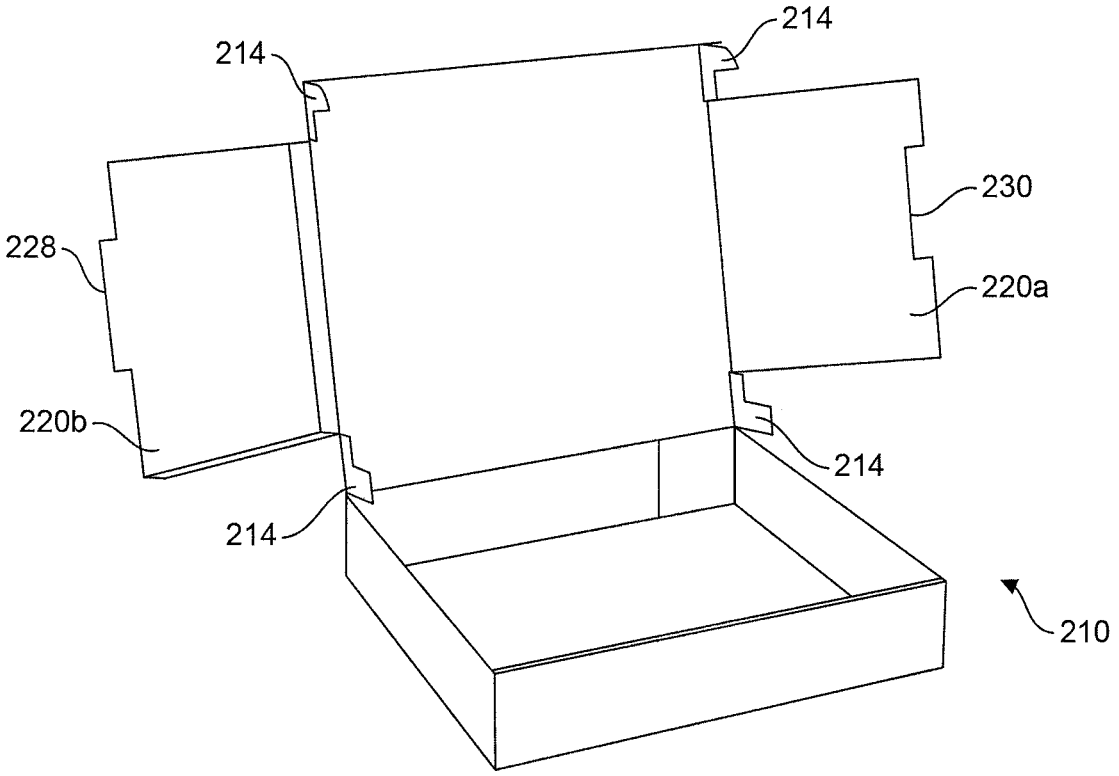
FIG. 22 is a perspective view of an embodiment of the pizza box and plate pocket of FIG. 21, with optional closure mechanism.
Figure 23:
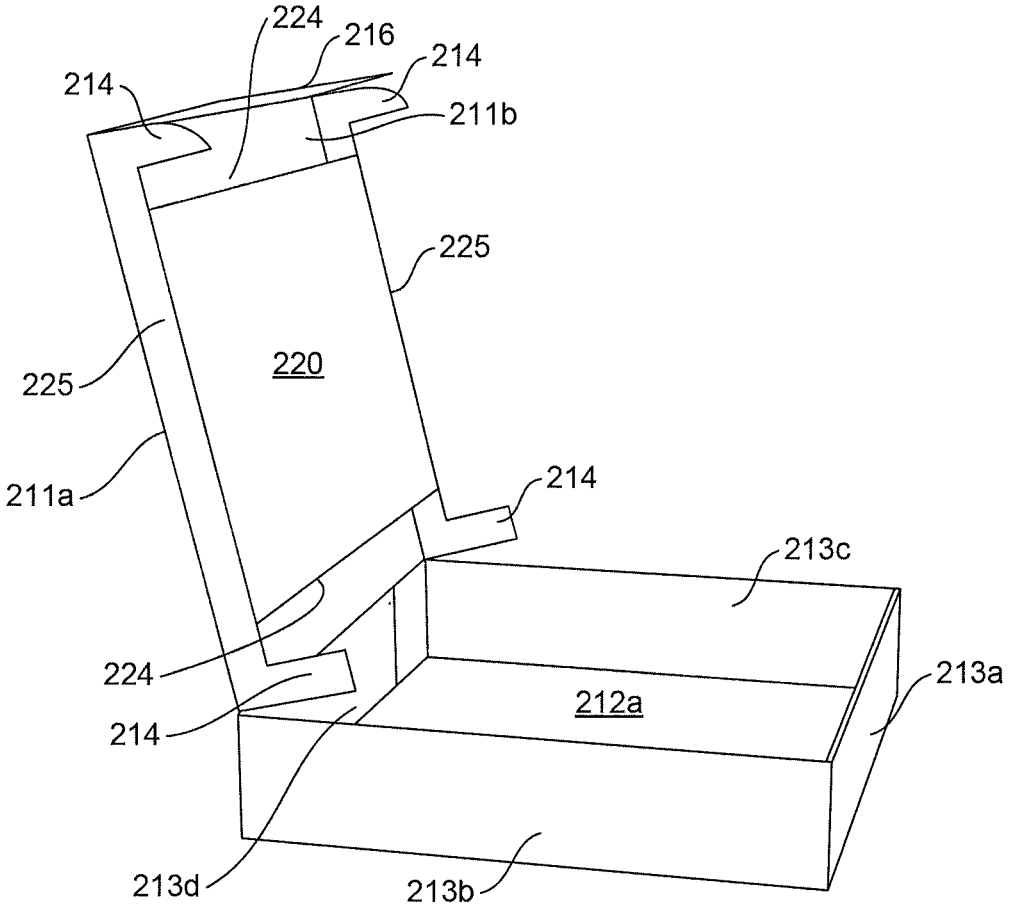
FIG. 23 is a side perspective view of an embodiment of the pizza box and plate pocket of FIG. 22, with the plate pocket in the assembled position.
Figure 24:
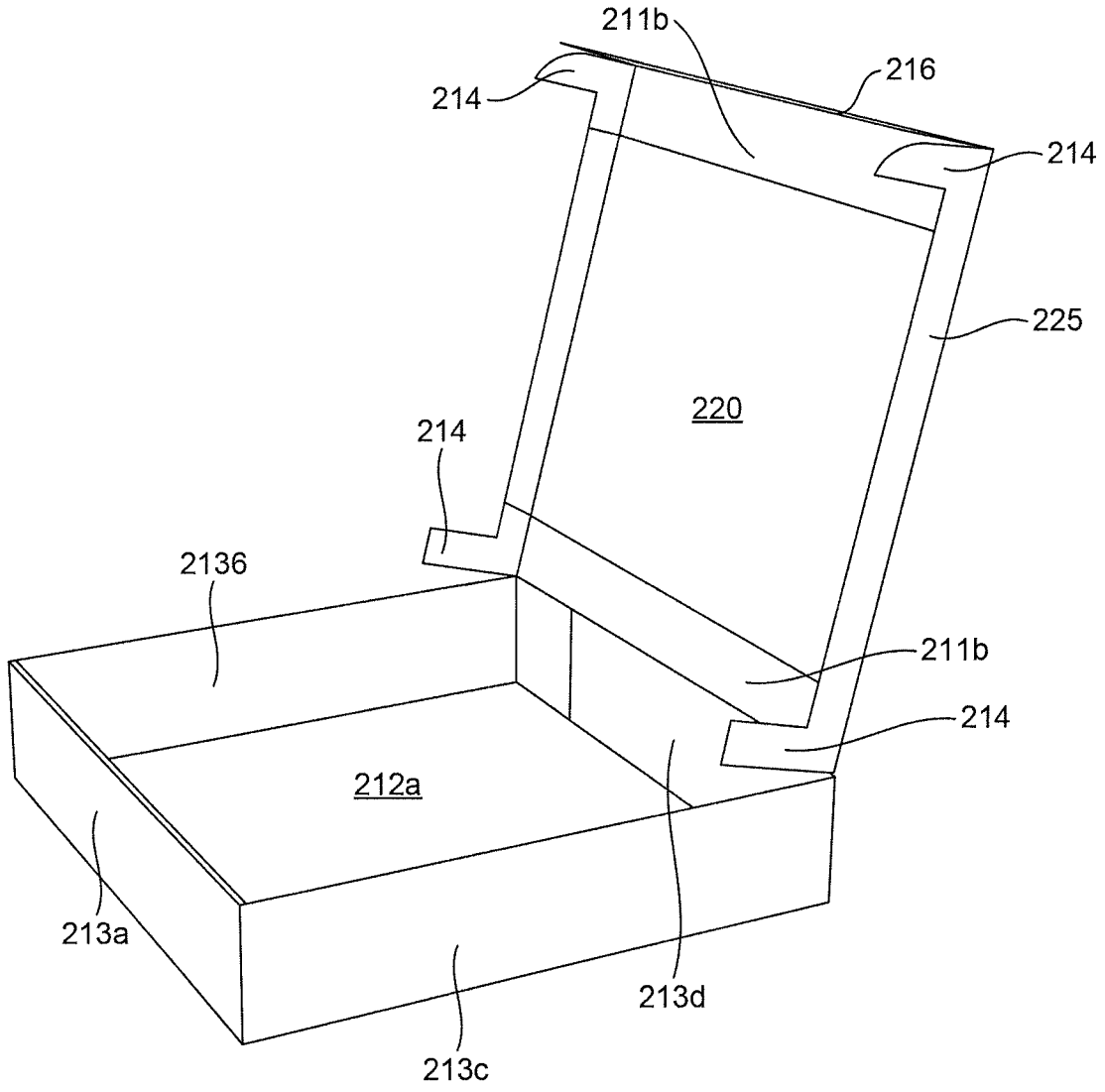
FIG. 24 is a side perspective view of an embodiment of the pizza box and plate pocket of FIG. 22, with the plate pocket in the assembled position.
Figure 25:
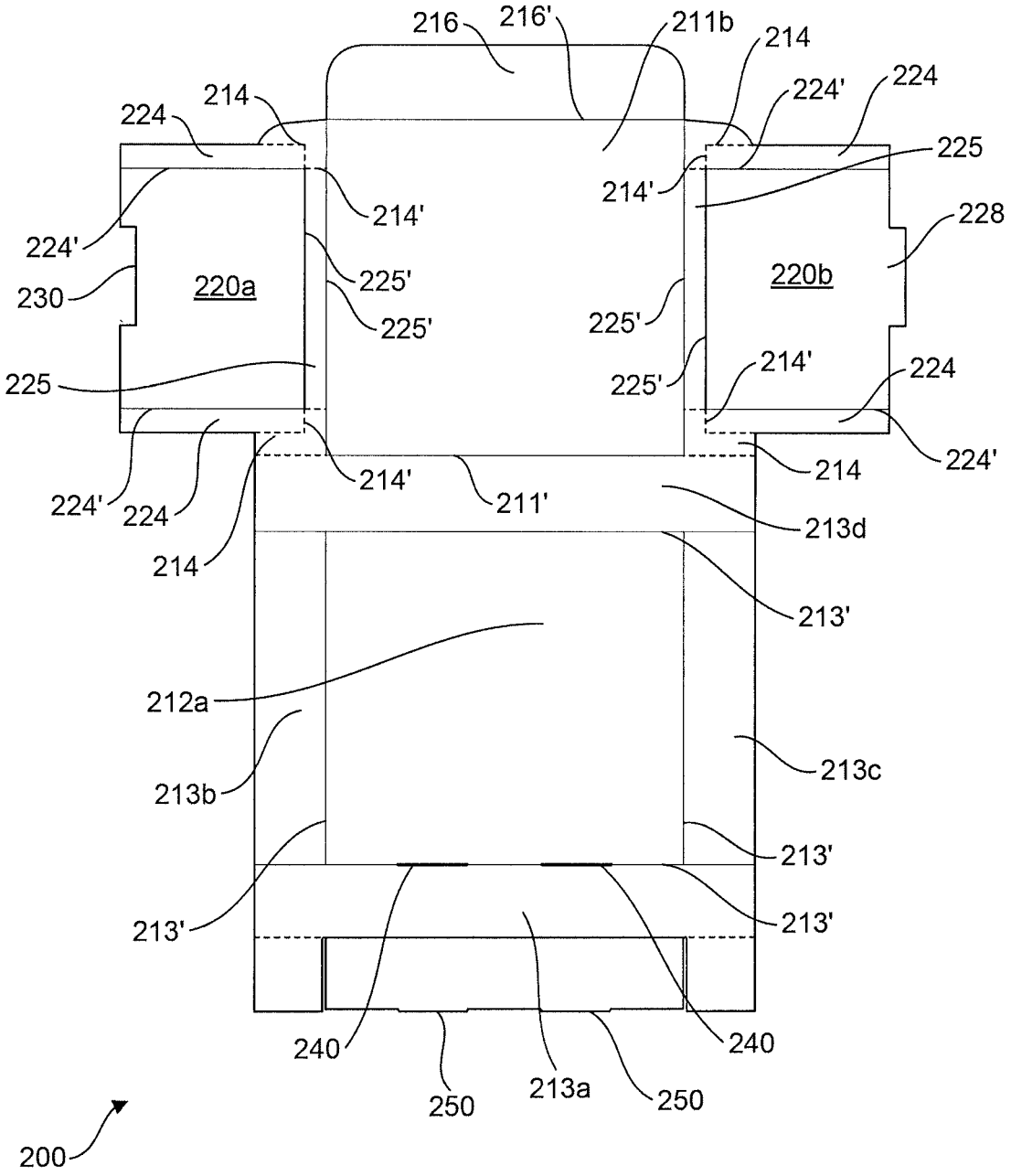
FIG. 25 is a top plan view of an unassembled pizza box and plate pocket of FIGS. 20-24.
Figure 26:
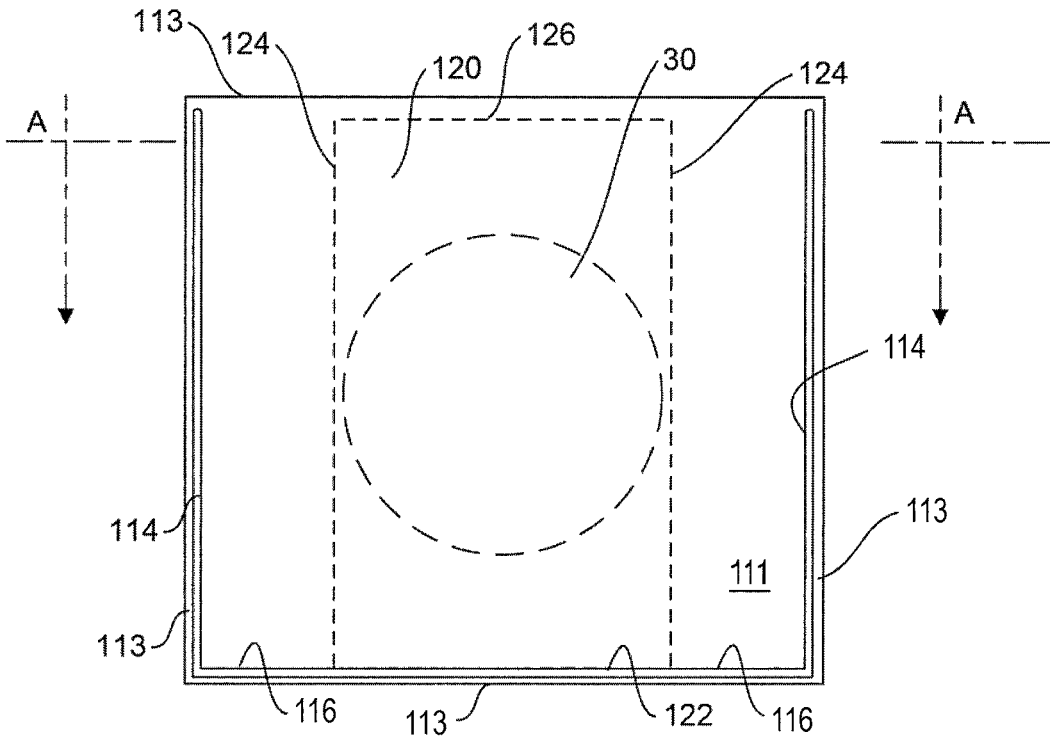
FIG. 26 is a top plan view of the assembled pizza box and plate pocket of FIG. 19, with the box in the closed position, showing the plate pocket and plate accessories in phantom lines.
Figure 27:
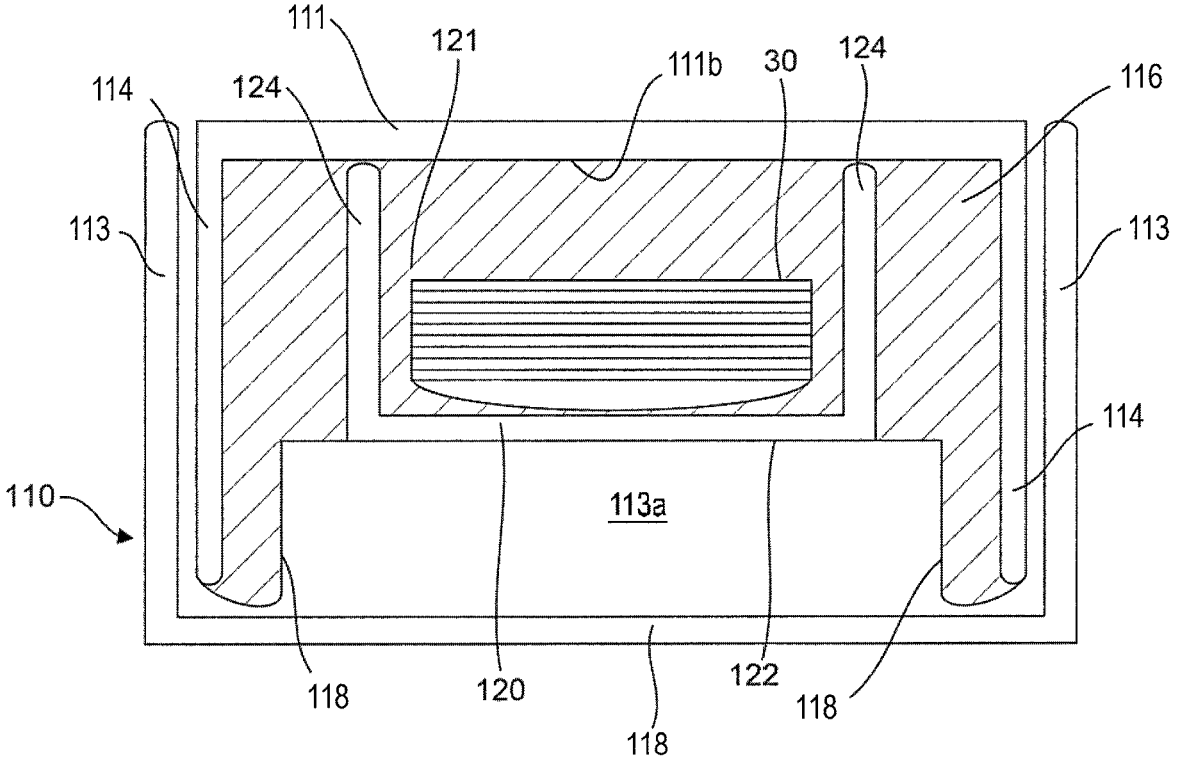
FIG. 27 is a side cross-sectional view of FIG. 26, along lines A-A.
Figure 28:
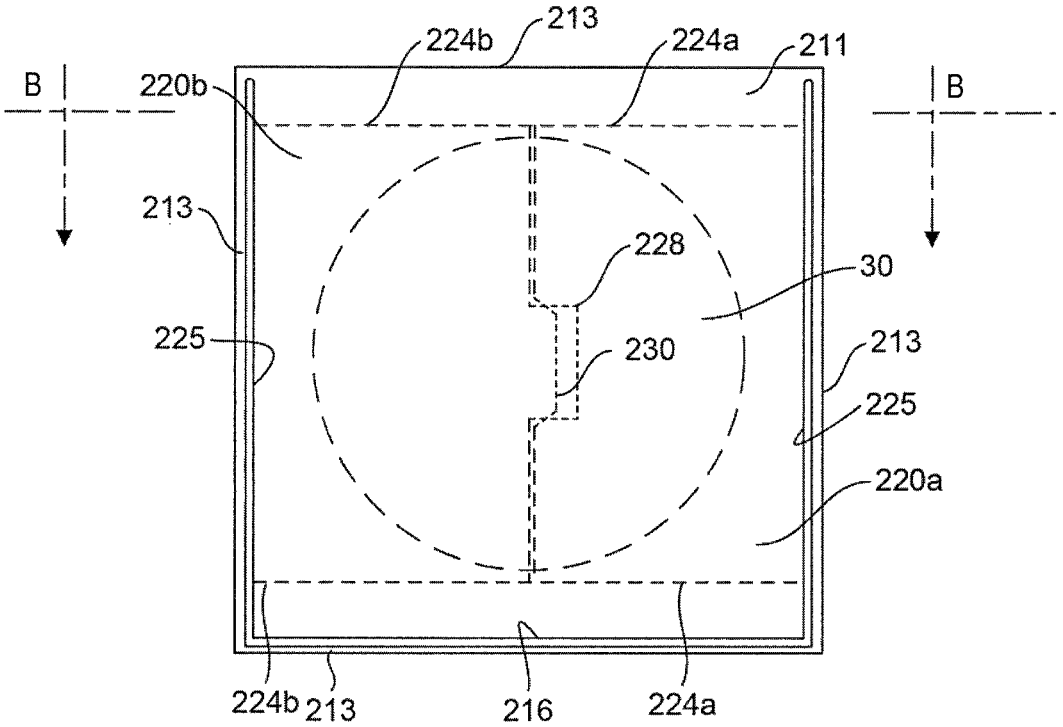
FIG. 28 is a top plan view of the assembled pizza box and plate pocket of FIG. 19, with the box in the closed position, showing the plate pocket extension members and plate accessories in phantom lines.
Figure 29:
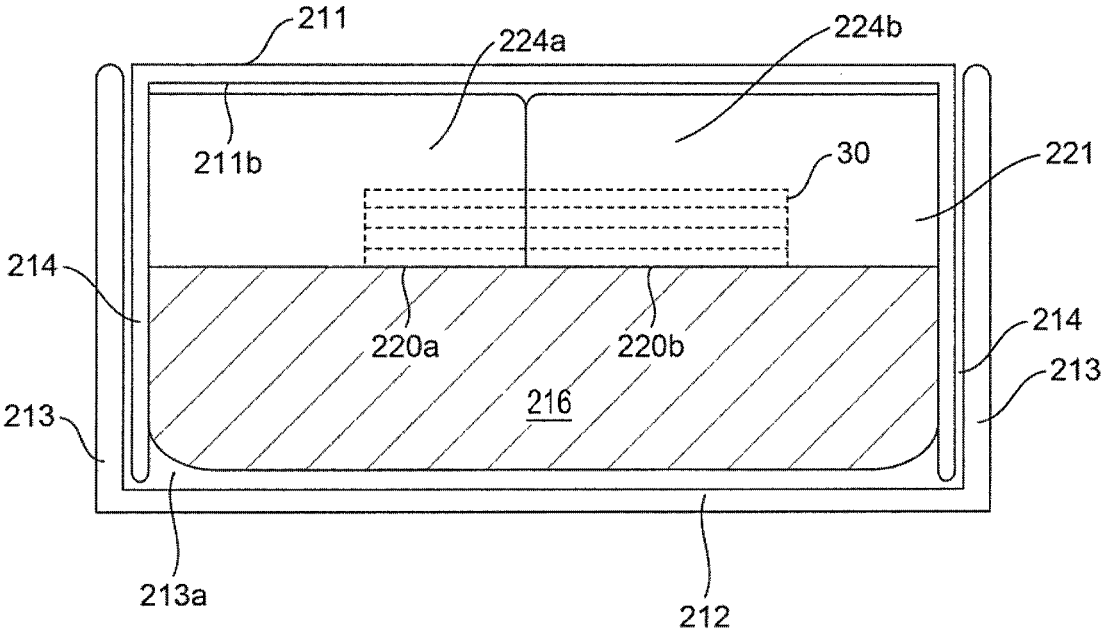
FIG. 29 is a side cross-sectional view of FIG. 26, along lines B-B.
Figure 30:
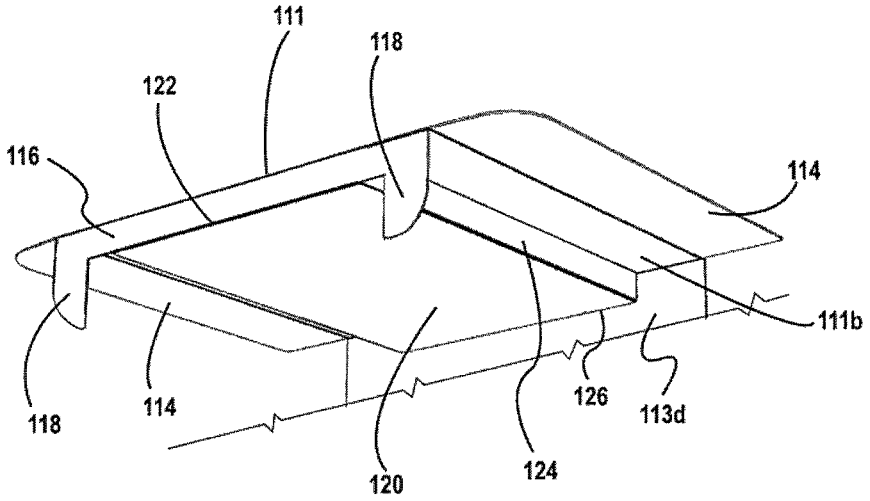
FIG. 30 is a partial, bottom perspective view of the pizza box of 19, depicting an assembled plate pocket as secured to the box lid.
Figure 31:
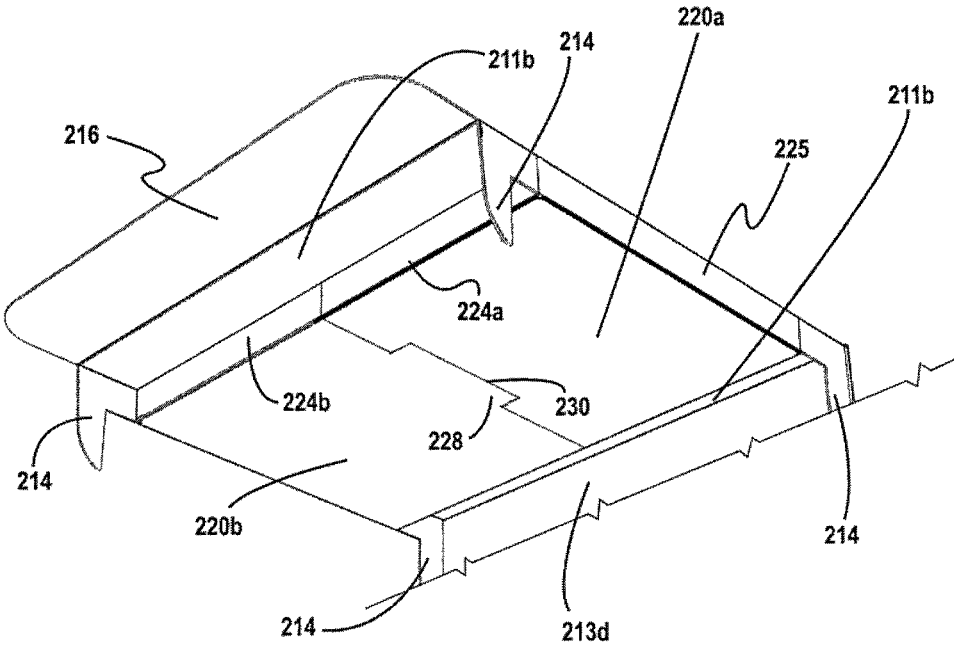
FIG. 31 is a partial, bottom perspective view of the pizza box of FIG. 21, depicting the extension members of an assembled plate pocket as secured to the box lid.

In one or more embodiments, like those seen in FIGS. 22 and 25, extension members 220*a*, 220*b* may further comprise either male connecting portion 228 and/or female connecting portion 230 to provide an additional engagement mechanism to form plate pocket 220. While the embodiments depicted in FIGS. 22 and 25 show a single male/female connecting portion on the extension members 220*a*, 220*b*, other configurations are not meant to be precluded, and any number of male/females connecting portions may be utilized on the plate pocket 220 to ensure proper formation of the pizza box 210. Further, each extension member may comprise any combination of male connecting portions 228, female connecting portions 230, or both. During assembly, the extension members 220*a*, 220*b* are moved towards the box lid bottom surface 211*b* such that the male connecting portion(s) 228 are received within the female connecting portion(s) 230 to form the plate pocket 220. After forming the plate pocket 200, additional adhesives such as glue or tape may be applied to the extension members 220*a*, 220*b* to further secure the connection and maintain plate pocket accessories within the plate pocket interior cavity 221.

Access to the plate pocket interior 221 may be accomplished by opening the pizza box lid when the box is in the closed position, thereby exposing the base top surface 212*a*, plate pocket extension members 220*a*, 220*b*, and lid bottom surface 211*a*. Upon separating the male/female connecting portions, glue, tape, or the like securing plate pocket extension members 220*a*, 220*b*, the extension members may be moved to an open position, thereby exposing the loaded plate pocket accessories within the cavity created between the plate pocket extension members 220*a*, 220*b* and the lid bottom surface 211*a*.

The method of assembling the embodiments of the pizza box may be described with reference to FIGS. 20 and 25. A pizza blank 100, 200 comprising a single piece of material is cut to dimensions which would facilitate the placement of a pizza, calzone, or other food item as well as plate pocket accessories such as utensils, napkins, and/or plates within the assembled box 110, 210. The blank comprises a material such as cardboard, paper, wood, plastics, hardboard, chipboard, or any other similar material known in the art which may be of rigid or semi-rigid construction. To facilitate folding, the pizza blank 100, 200 may include one or more scored lines, perforations, creases, indents, and the like such that the box is capable of being hingedly folded and unfolded without compromising the structural integrity of the box.

During assembly, a user may form the upstanding sidewalls 113, 213 by folding fold lines 113', 213' inwardly towards the interior portion of the base top surface 112*a*, 212*a*, thereby forming the cavity within the box 110, 210 for placement of a pizza, calzone, or other food item therein. To prevent the sidewalls from unfolding, at least one of sidewalls may include at least one locking projection 150, 250 which may be inserted within complementary locking slot(s) 140, 240 to secure the sidewalls 113, 213 in a position approximately perpendicular to the base 112, 212.

In assembling the pizza box of the embodiments depicted in FIG. 20, the user may fold the blank 100 along lid fold lines 114', 116', 118' to form the lid portion 111 and sidewalls 114, 116. Upon folding fold lines 124' to form the plate pocket sidewalls 124 approximately perpendicular to the plate pocket, plate pocket 120 may be folded along upper plate portion 122 toward lid bottom surface 111*b* such that the surface of the plate pocket 120 is substantially parallel to the lid 111. In some embodiment, the user may insert the tab portion(s) 128 within the opening(s) 130, securing the plate pocket 120 to the lid bottom surface 111*b*, though other forms of attachment, such as in-line glue or tape are not meant to be precluded.

In assembling the pizza box of the embodiments depicted in FIG. 25, the user may fold the blank 200 along lid fold lines 214', 216' to form the lid portion 211 and sidewalls 214, 216. Upon folding of fold lines 224', 225' plate pocket sidewalls and the peripheral wall may be folded inwardly approximately perpendicular to the plate pocket portions 220*a*, 220*b*. Plate portions 220*a*, 220*b* may subsequently be folded towards lid bottom surface 211*b*. After placement of the plate portions 220*a*, 220*b* adjacent one another such that the plate portions 220*a*, 220*b* form a surface approximately parallel with the lid 211, a user may subsequently secure the plate portions through adhesives such as inline glue or tape, interconnecting the male/female connecting portions 228, 230, or both.

Once assembled, the pizza box of the aforementioned embodiments comprise plate pocket 120, 220, secured to the pizza box lid 111, 211, respectively. Thus, plate pocket accessories such as plates, utensils, napkins, and the like may be placed within the interior 121, 221 of the plate pocket for access after assembly. Due to the modular nature of the embodiments described in FIGS. 19-25, prior to folding the plate pocket into the assembled position, plate pocket accessories may be placed within the plate pocket, lid bottom surface, or both during box assembly, such that the accessories may be loaded within the box blank prior to complete assembly of the pizza box. Placement of the plate pocket accessories during assembly of the pizza box provides additional efficiency and cost-savings, while simultaneously providing different modalities and methodologies of accessing the plate pocket accessories after assembly of the box. Thus, the present invention provides an improved system, apparatus and method for packaging and delivering serving plates, utensils, napkins, and other accessories along with a pizza, calzone, or other takeout food-based item in the same size as an otherwise standard pizza box. The method of assembly the present invention provides for a more efficient and cost-effective method of assembly. Further, due to the method of assembly, a manufacturer can ensure quality control and proper hygienic loading of the plate pocket accessories.

While the present invention has been particularly described, in conjunction with one or more specific embodiments, it is evident that many alternatives, modifications and variations will be apparent to those skilled in the art in light of the foregoing description. It is therefore contemplated that claims to the invention will embrace any such alternatives, modifications and variations as falling within the true scope and spirit of the present invention.

Thus, having described the invention, what is claimed is:

1. A partially cut or perforated sheet of material configured to be folded into a pizza box comprising:

a base having sidewalls extending from its edges and foldable to be perpendicular to said edges;

a box lid having a top surface and a bottom surface connected to one of said base sidewalls, the box lid further having foldable flaps extending from its edges, and at least one projection cut into said foldable flaps such that the at least one projection may be pushed to swivel inwards;

a plate pocket extending from and attached to an edge of the lid via connecting members, the plate pocket capable of being folded into the lid; and a plate pocket lid formed from the box lid top surface via a cut or perforations cut into the box lid, wherein a portion of the plate pocket lid is not cut or perforated to act as a living hinge to allow for the plate pocket lid to swing between an open position exposing the inside of the plate pocket to a closed position resting flush with the box lid top surface;

wherein the plate pocket may be folded into the lid and held in place by swiveling the at least one projection inward from the lid foldable flaps such that a base of the plate pocket is contacted and held in place by said at least one projection.

2. The pizza box of claim 1 further including pocket flaps extending from the edges of the plate pocket.

3. The pizza box of claim 1 wherein the plate pocket lid has dimensions comparable to the plate pocket.

4. The pizza box of claim 1 further including a lid tab disposed on an end of the plate pocket lid opposite the living hinge to allow for easier grip and control of the plate pocket lid when swinging the plate pocket lid about its living hinge.

5. The pizza box of claim 1 wherein the plate pocket is formed in a substantially ellipse shape.

6. The pizza box of claim 5 wherein the plate pocket lid is also formed in a substantially ellipse shape.

7. The pizza box of claim 1 wherein the plate pocket is formed to substantially cover an inside surface of the box lid, such that connecting flaps of the plate pocket adhere to the bottom surface of the box lid, or to foldable flaps or flanges that extend downwardly from a perimeter of the box lid.

8. The pizza box of claim 7 wherein the plate pocket lid is formed into a parallelogram shape.

9. A box useful for takeout food comprising:

a base having sidewalls extending therefrom;

a box lid having a top surface and a bottom surface, said box lid hingedly connected to one of said base sidewalls, the box lid further having foldable flaps extending therefrom; and a plate pocket extending from and attached to an edge of the box lid, the plate pocket comprising a base with sidewalls extending therefrom, said plate pocket sidewalls extending towards the box lid bottom surface when the box is in an assembled position;

wherein the plate pocket is movable between a closed position wherein an interior portion of the plate pocket is inaccessible to an open position wherein the interior of the plate pocket is accessible.

10. The box of claim 9 wherein the plate pocket comprises at least one tab member for connective mating with at least one opening on the box lid.

11. The box of claim 9 wherein the plate pocket interior portion includes plate pocket accessories.

12. A box useful for takeout food comprising:

a base having sidewalls extending therefrom;

a box lid having a top surface and a bottom surface, said box lid hingedly connected to one of said base sidewalls, the box lid further having foldable flaps extending therefrom;

a first plate pocket extension member hingedly attached to an edge of the box lid, the first plate pocket extension member comprising a first base with sidewalls extending therefrom; and a second plate pocket extension member hingedly attached to an edge of the box lid opposite the first plate pocket extension member, the second plate pocket extension member comprising a second base with sidewalls extending therefrom;

wherein the first and second plate pocket extension members are movable between a closed position wherein the first and second plate pocket extension members are approximately parallel to the box lid bottom surface and access to an interior portion of the first and second plate pocket extension members is not permitted, to an open position wherein access to the interior portion of the first and second plate pocket extension members is permitted.

13. The box of claim 12 wherein the first plate pocket extension member comprises a male or female connecting portion and the second plate pocket extension member comprises a female or male connecting portion for complementary connection with the male or female connecting portion of the first plate pocket extension member in the closed position.

14. The box of claim 12 wherein the interior portion of the first and second plate pocket extension members include plate pocket accessories.

* * * * *